US006418684B1

(12) United States Patent
Morton

(10) Patent No.: US 6,418,684 B1
(45) **Date of Patent: *Jul. 16, 2002**

(54) WALL REINFORCEMENT APPARATUS AND METHOD USING COMPOSITE MATERIALS

(75) Inventor: Steven E. Morton, Pickerington, OH (US)

(73) Assignee: Engineered Composite Systems, Inc., Orient, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,966

(22) Filed: Oct. 27, 2000

Related U.S. Application Data

(63) Continuation-in-part of application No. 09/250,506, filed on Feb. 16, 1999, now Pat. No. 6,145,260
(60) Provisional application No. 60/222,830.

(51) Int. Cl.[7] ..... E04B 1/14
(52) U.S. Cl. ..... 52/293.2; 52/293.3; 52/309.1; 52/506.01; 52/506.05; 52/736.3; 52/738.1
(58) Field of Search ..... 52/293.2

(56) References Cited

U.S. PATENT DOCUMENTS 5,308,430 A 5/1994 Saito et al.
5,326,630 A 7/1994 Saito et al.
5,447,593 A 9/1995 Tanaka et al.
5,640,825 A * 6/1997 Ehsani et al. ..... 428/408
5,711,834 A * 1/1998 Saito ..... 156/153
6,145,260 A * 11/2000 Morton ..... 52/293.2

* cited by examiner

*Primary Examiner*—Carl D. Friedman
*Assistant Examiner*—Basil Katcheves
(74) *Attorney, Agent, or Firm*—Jason H. Foster; Kremblas, Foster, Phillips & Pollick

(57) ABSTRACT

A wall reinforcing method including reinforcing members adhered to the wall. The reinforcing members are either pre-cured composite plates or composite members formed in situ, that is, a fabric of reinforcing fibers that is saturated with an adhesive to form the matrix of the composite and to adhere the reinforcement to the wall. The in situ members are either strips of fabric or wide sheets that cover most of the wall. The spacing of the reinforcing members is determined, in one embodiment, by an array of spacing distances. The array, which is preferably in table form, is consulted by the installer who first measures some of the wall parameters and environmental characteristics.

23 Claims, 17 Drawing Sheets

Fig. 22

For 10" Masonry Block Walls

Spacing of The Reinforcer along length of wall.

Height of Backfill (h) in feet

| Inside Wall Height (H) | 6'-4" | 7'-0" | 7'-4" | 7'-8" | 8'-0" | 8'-4" | 8'-8" | 9'-0" | 9'-4" | 9'-8" | 10'-0" |
|---|---|---|---|---|---|---|---|---|---|---|---|
| 7'-0" | 5'-0" | 5'-0" | | | | | | | | | |
| 7'-4" | 5'-0" | 5'-0" | 4'-6" | | | | | | | | |
| 7'-8" | 5'-0" | 5'-0" | 4'-6" | 4'-6" | | | | | | | |
| 8'-0" | 5'-0" | 5'-0" | 4'-6" | 4'-6" | 4'-6" | | | | | | |
| 8'-4" | 5'-0" | 4'-6" | 4'-6" | 4'-6" | 4'-6" | 4'-0" | | | | | |
| 8'-8" | 5'-0" | 4'-6" | 4'-6" | 4'-6" | 4'-6" | 4'-0" | 4'-0" | | | | |
| 9'-0" | 5'-0" | 4'-6" | 4'-6" | 4'-6" | 4'-6" | 4'-0" | 4'-0" | 3'-8" | | | |
| 9'-4" | 5'-0" | 4'-6" | 4'-6" | 4'-6" | 4'-6" | 4'-0" | 4'-0" | 3'-4" | 3'-0" | | |
| 9'-8" | 5'-0" | 4'-6" | 4'-6" | 4'-6" | 4'-6" | 4'-0" | 3'-8" | 3'-2" | 2'-8" | 2'-4" | |
| 10'-0" | 5'-0" | 4'-6" | 4'-6" | 4'-6" | 4'-6" | 4'-0" | 3'-6" | 3'-0" | 2'-6" | 2'-2" | 1'-9" |

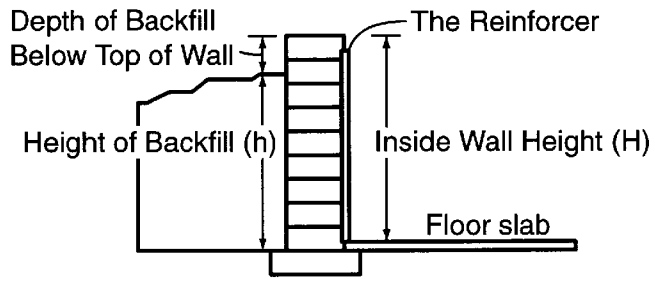

Height of Backfill (h) = Inside Wall Height minus the depth of backfill below the top of wall.
h = H – Ground level below top of outside wall.
Table is based on an equivalent fluid pressure of 50#/ft$^3$.

Fig. 23

For 10" Concrete Walls

Spacing of The Reinforcer along length of wall.

Height of Backfill (h) in feet

| Inside Wall Height (H) | 6'-4" | 7'-0" | 7'-4" | 7'-8" | 8'-0" | 8'-4" | 8'-8" | 9'-0" | 9'-4" | 9'-8" | 10'-0" |
|---|---|---|---|---|---|---|---|---|---|---|---|
| 7'-0" | 5'-0" | 5'-0" | | | | | | | | | |
| 7'-4" | 5'-0" | 5'-0" | 4'-6" | | | | | | | | |
| 7'-8" | 5'-0" | 5'-0" | 4'-6" | 4'-0" | | | | | | | |
| 8'-0" | 5'-0" | 5'-0" | 4'-6" | 4'-0" | 4'-0" | | | | | | |
| 8'-4" | 5'-0" | 5'-0" | 4'-6" | 4'-0" | 4'-0" | 4'-0" | | | | | |
| 8'-8" | 5'-0" | 5'-0" | 4'-6" | 4'-0" | 4'-0" | 4'-0" | 4'-0" | | | | |
| 9'-0" | 5'-0" | 4'-0" | 4'-0" | 4'-0" | 4'-0" | 4'-0" | 4'-0" | 4'-0" | | | |
| 9'-4" | 5'-0" | 4'-0" | 4'-0" | 4'-0" | 4'-0" | 4'-0" | 4'-0" | 4'-0" | 4'-0" | | |
| 9'-8" | 5'-0" | 4'-0" | 4'-0" | 4'-0" | 4'-0" | 4'-0" | 4'-0" | 4'-0" | 3'-9" | 3'-6" | |
| 10'-0" | 5'-0" | 4'-0" | 4'-0" | 4'-0" | 4'-0" | 4'-0" | 4'-0" | 3'-9" | 3'-8" | 3'-4" | 3'-2" |

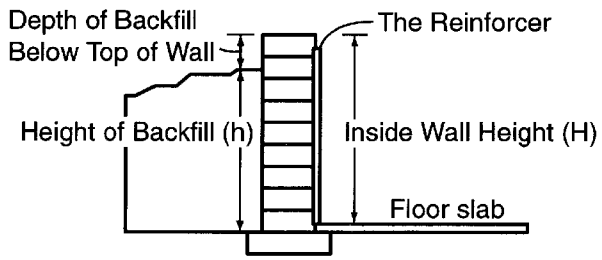

Height of Backfill (h) = Inside Wall Height minus the depth of backfill below the top of wall.
h = H – Ground level below top of outside wall.
Table is based on an equivalent fluid pressure of 50#/ft$^3$.

WALL REINFORCEMENT APPARATUS AND METHOD USING COMPOSITE MATERIALS

(b) CROSS-REFERENCES TO RELATED APPLICATIONS

This application is a continuation-in-part of U.S. application Ser. No. 09/250,506, filed Feb. 16, 1999, now U.S. Pat. No. 6,145,260 and claims the benefit of U.S. Provisional Application No. 60/222,830 entitled "Improved Wall Reinforcing Apparatus and Method" and filed on Aug. 4, 2000 with Express Mail Label No. EL618950838US.

(c) STATEMENT REGARDING FEDERALLY-SPONSORED RESEARCH AND DEVELOPMENT (Not Applicable)

(d) REFERENCE TO A "MICROFICHE APPENDIX"

(Not Applicable)

(e) BACKGROUND OF THE INVENTION

1. Field of the Invention

This invention relates generally to reinforcement of walls, especially masonry walls of solid, unitary cast concrete construction or block walls. This invention also relates to reinforcement of walls constructed of wood, metal or other materials. More specifically, the invention relates to reinforcement of a wall by adhering fiber-reinforced polymer composite (FRPC) material to at least one surface of the wall.

2. Description of the Related Art

The earth adjacent a subterranean wall exerts a vertical force resulting from its weight, and it exerts a substantial horizontal force, due to its fluid properties, that increases in proportion to depth. Although this horizontal force is otherwise opposed and counteracted by the adjacent soil in other places within the earth, the wall, which is interposed within the earth, must support that lateral load.

Any subterranean wall may at some subsequent time be found structurally inadequate to satisfactorily resist the horizontal force of the earth directed against the exterior surface of the wall W. There are many diverse factors that can cause a wall to become structurally inadequate to resist the forces exerted against its exterior surface, thus requiring some remedial action to prevent or lessen the likelihood of serious damage or possibly catastrophic failure.

Reinforcing of concrete masonry structures by means of exterior application of rigid metal plates to surfaces of such structures by mechanical fastening devices is a known practice. An example of this practice is illustrated in U.S. Pat. No. 5,640,825 issued Jun. 24, 1997 to Ehsani, Mohammad R., et al. These plates are utilized to subsequently attach the ends of elongated, flexible straps of sheet-form having short, randomly oriented non-metallic fibers with the straps secured in a horizontally disposed position to the wall's surface by an adhesive epoxy that is then cured. The metal plates engage with longitudinal end portions of the straps and are mechanically secured to adjacent structure that supports the wall.

It is also known to strengthen load-bearing concrete floors by using carbon fibre reinforced polymer (CFRP) strips. This is accomplished through bonding of elongated strips of CFRP to the underside of horizontally disposed concrete floors with these strips counteracting tensile forces. These CFRP strips may also be utilized for strengthening roof sections to better accommodate roof loading generated by wind, accumulations of snow and combinations of wind and snow. The CFRP strips are applied in laterally spaced parallel relationship by use of a suitable adhesive. These strips may also be applied in overlying relationship to a previously applied set but not to the surface of the concrete structure being strengthened. These strips are disposed in orthogonal arrangement to the previous set and adhesively bonded thereto.

Three previously issued U.S. patents disclosing related subject matter were noted as a result of investigating existing reinforcing techniques utilized in strengthening concrete structures. These patents are listed as follows:

[1] U.S. Pat. No. 5,308,430 issued May 3, 1994 to Saito, Makoto, et al.;

[2] U.S. Pat. No. 5,326,630 issued Jul. 5, 1994 to Saito, Makoto, et al.; and

[3] U.S. Pat. No. 5,447,593 issued Sep. 5, 1995 to Tanaka, Tuneo, et al.

Each of these three patents discloses a similar structural unit that provides the tensile stress resistive component for effecting strengthening of the concrete structural element to which it is applied. Each comprises a plurality of elongated fibers aligned in parallel groups embedded in an uncured matrix of thermosetting resin in a sheet structure. This structural sheet is adhered with a thermosetting resin applied to a surface of the structural element to be strengthened. The sheets are positioned on the structural element to obtain the most effective utilization of the tensile attributes of the fibers. Along with positioning of the fiber sheets with the resin, the entire mass is subjected to ambient room temperature or application of heat at an elevated temperature appropriate to cure the matrix and resins.

Another technique previously used in effecting strengthening of walls comprises utilization of a plurality of elongated structural steel beams vertically disposed in spaced parallel relationship along the inwardly facing surface of a wall. These beams are of a size and cross-sectional configuration to have sufficient strength to counteract inward flexing of the wall that would otherwise result from any unexpected excessive increase in horizontally directed forces applied to the outwardly facing surface of the wall. Each of the beams, which may be of "I", "T", "L"-shaped angle, "C"-shaped channel or other suitable configuration, has a flat-surfaced component that is positioned in contacting engagement with the wall's surface. The upper end of each beam is mechanically secured to an overlying joist and the bottom ends are fixed to the floor, which, in a basement wall-strengthening situation, is typically formed of concrete. A typical technique of securing a beam to a concrete floor comprises forming a socket in the floor for each beam, inserting the beam's lower end in a respective socket, filling the socket with concrete which is permitted to harden thereby holding the beam upright and against the wall, and then securing the upper end to a joist. This technique results in a structure that is not only objectionably intrusive into a basement's interior space but is a costly and time-consuming procedure.

(f) BRIEF SUMMARY OF THE INVENTION

A major aspect of this invention is a method of strengthening vertically disposed masonry walls to increase their ability to resist laterally directed forces that may be applied to one surface of the wall. Once practiced, the method enhances the lateral strength of basement walls of residential homes and similar walls of commercial buildings. These walls are generally substantially subterranean with earth surrounding the building and disposed against the exterior surface of the wall.

A basic embodiment of this invention comprises a rigid, elongated, fiber reinforced polymer plate that is adhesively bonded to an interior surface of a masonry wall to strengthen the wall to resist horizontally directed forces applied to its exterior surface. The plate is relatively thin compared to its width and is positioned in a generally vertical orientation with one of its major, flat surfaces placed in coplanar relationship to the wall's surface to which it is bonded by an intervening layer of an adhesive bonding agent. The plate is preferably of a length to extend the full height of the wall.

For a wall of substantial length a plurality of plates are used with the plates being disposed in spaced parallel relationship along the length of the wall. Spacing of the plates and the number required for a given length of wall is dependent upon the maximum expected earth and water loading forces to be applied horizontally against the exterior surface of the wall. Other factors entering into this determination are the thickness and width of the plates in addition to the vertical height of the wall.

Thus it is an additional preferred step in the process of forming the reinforcement of the wall that an array in the form of a table, containing calculated spacing distances, be consulted and that the plates be spaced according to the table.

Fabrication of the reinforcing plates of this invention comprises embedding a layer of carbon or glass or other reinforcing fibers in a matrix of resin that can be vinylester, polyester, epoxy or an other type. Next, the resin is cured resulting in a rigid plate having a predetermined structural strength. The fibers are oriented in parallel relationship and of a length to extend the full longitudinal length of the plate.

Mechanical anchoring of the plates to the wall at their top and bottom ends through use of fastening devices in combination with anchor plates is also contemplated to enhance the attachment strength of the plates to the wall. These anchor plates may be square sections of the reinforcing plate placed in overlying relationship to the outwardly facing surface of the plates and secured thereto by an adhesive bonding agent. Rectangular sections of the reinforcing plate may also be used, thereby distributing the anchoring force over an elongated length of a plate.

In a second embodiment of this invention the reinforced fibers are formed into a fabric-type sheet of material. The fibers are disposed in parallel, closely adjacent relationship forming a layer that is secured together by transversely extending high tensile strength fibers. This sheet is designed to be positioned in coplanar, overlying relationship to the interior surface of the masonry wall to which it is secured by a bonding resin, thereby providing waterproofing in addition to strengthening the wall.

Although the waterproofing sheet can be utilized by itself as described in the preceding paragraph it can also be used in combination with the rigid, fiber reinforced polymer plates. After application of the plates, the waterproofing sheet is applied. It may either be applied in a single, continuous sheet that overlies the vertically extending plates, or it may be applied in sections that fit between adjacently disposed pairs of the plates, and abut facing edges of each plate. The combination provides significant enhancement of the strengthening effect along with the added advantage of providing waterproofing.

An adhesive bonding resin is utilized in both securing a first sheet to the wall and in bonding the fibers in the sheet together as the resin will absorb into the mat as the resin is adsorbed by each fiber, and between the fibers when the sheet is pressed against the wall. Similarly, an adhesive bonding agent is applied to the outer surface of a previously applied sheet and bonds the next sheet to the prior sheet in addition to being absorbed by the fibers of this next applied sheet as it is pressed against the prior sheet.

In addition to forming in situ sheets, such as the waterproofing sheets described above, it is also contemplated that narrow strips of a similar fabric can be used to form reinforcing members mounted to the wall. These in situ formed reinforcing members are spaced, as described above, according to the necessary reinforcement of the wall.

Because a saturating adhesive can be absorbed too rapidly into the porous wall by capillary action, it is also an embodiment of the invention to apply a more highly viscous paste epoxy or other suitable filler to the wall prior to mounting the waterproofing sheet and the fabric strips to the wall. The paste adheres to the porous wall but prevents the lower viscosity saturating adhesive from being drawn from the fabric sheets or strips.

Additionally, it is contemplated to form, such as by sawing, a plurality of grooves in a wall and insert adhesive in the groove. Next, an elongated bar, such as a cylindrical rod, is placed in the groove. This forces the adhesive against the groove walls and permits substantial adhesion thereto. The adhesive is preferably smoothed to form a continuous surface on the interior wall surface.

Utilization of this invention is particularly advantageous with masonry or concrete walls but its utility is not limited to those walls. The strengthening and waterproofing elements may be used with the walls of structures fabricated from other materials such as, for example, wood or metal.

It is the primary objective of this invention, therefore, to provide an effective method of strengthening masonry or concrete walls of the type herein described after they have been constructed. This is accomplished by applying components at and near the interior surface of a wall thereby avoiding relatively costly work on the exterior of the wall.

These and other objects and advantages of this invention will become more clearly apparent from the following detailed description of the invention and the accompanying drawings.

(g) BRIEF DESCRIPTION OF THE SEVERAL VIEWS OF THE DRAWINGS

FIG. 22 is an array in table form for ten inch block walls.

FIG. 23 is an array in table form for ten inch concrete walls.

Figure 1:
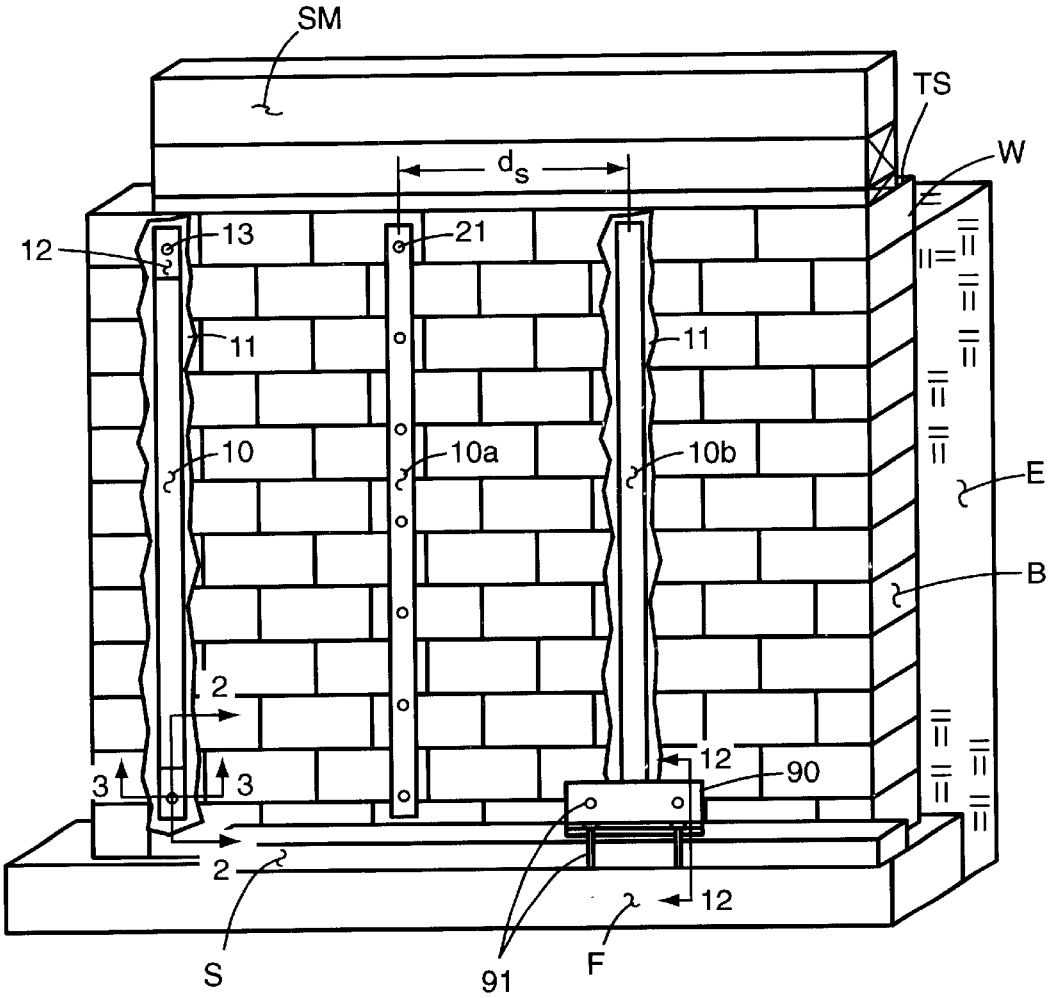
FIG. 1 is a view in perspective illustrating a masonry wall with plates mounted thereto.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

(h) DETAILED DESCRIPTION OF THE INVENTION

Referring to the drawings, and in particular to FIG. 1 for this introductory description of an exemplary installation, a portion of a typical basement wall W of a residential building is shown as constructed in the known customary environment. That environment includes a footer F commonly fabricated from concrete and extending around the periphery of the building's excavation. It is normally rectangular in cross-section with an upper horizontal surface of greater width than the wall's thickness with the wall being built on that surface. The wall has a vertically extending interior surface IS and an outwardly facing exterior surface (not shown) which abuts the earth E that is filled in the excavated space after the wall is constructed. This earth illustrated in FIG. 1 is to be understood as being a continuation of a larger body of earth that surrounds the building, and provides the horizontal forces directed laterally against the wall's exterior surface. Recognition must also be given to the lateral force that is added by any ground water that may be present. For a more complete illustration of the basic building structure as it relates to the basement wall W, the initial structural members SM are shown positioned on and secured to the top surface TS of the wall around its perimeter. Also shown in the perspective views of these typical basement walls W is a section of a basement floor slab S having a peripheral marginal edge portion that rests on the footer F and is in abutting engagement with the wall.

Regardless of the particular construction technique employed in forming of a masonry wall W, whether it is solid poured concrete or the modular concrete block-type with the individual blocks or portions thereof designated by the letter B as shown in the drawings, these walls are generically termed masonry walls.

Referring to FIG. 1 it will be seen that three elongated reinforcing plates 10, 10*a* and 10*b* are mounted vertically to the wall in a spaced, parallel relationship. The reinforcing plates are adhered to the wall by use of a bonding resin 11 applied to the wall's surface IS or the contacting surface of the plate in a thin layer covering an area that is at least equal to the surface of the plate.

With the bonding resin applied and prior to curing, the reinforcing plate is firmly pressed into position against the wall with sufficient pressure to assure an effective bond.

It is to be understood that only a portion of a wall is shown and that additional plates are similarly affixed to the remainder of the wall. Although the plates on a wall are most likely of the same construction, they may be different and spaced apart at different distances. Typically, the plates 10 on a wall are of the same construction and size and are of a length to extend the full height of the wall from near the upper surface of the floor slab S to the near the top surface TS of the uppermost tier of blocks B.

The preferred carbon fiber reinforced plates are 75 mm wide by 1.27 mm thick, and 100 mm wide and 1.02 mm thick. The preferred glass fiber reinforced plates are 305 mm wide by 1.27 mm and 305 mm wide by 2.54 mm thick, but the plate used could vary from these dimensions. The type of plate used in a particular installation depends upon the structural parameters of the wall at issue, the cost and the preference of the installer. The height of the wall W is usually seven and one-half feet to eight feet in a residential building, but that is not a determinative criterion for practice of this invention. Similarly, the length and width of the modular blocks B are not relevant factors. However, the height of the blocks and the height of the wall are relevant factors in determining the spacing of the plates along a wall. The width and thickness of the plates also are relevant factors that are concurrently considered with the height of the blocks and of the wall in determining spacing of the plates.

The reinforcing plates 10 have very high tensile strength in the longitudinal direction, on the order of 130 KSI for glass fiber reinforced plates to 350 KSI for carbon fiber reinforced plates. Because of the high tensile strength and the adhesion of the plates to the interior surface of the wall, the plates increase the strength of the wall against the horizontally directed force of the earth or other force that tends to bend a wall inwardly.

The reinforcing plates are rigid, fiber-reinforced polymer (FRP) composites that may either have the fibers disposed unidirectionally or multi-directionally. If the fibers are unidirectionally oriented, they are disposed in parallel relationship to the plate's longitudinal axis to effect maximum tensile strength. If the fibers are disposed mulit-directionally, they are arranged in layers, and the fibers within each layer are parallel. However, the fibers in adjacent layers vary in orientation relative to the plate's longitudinal axis, forming angles between the fibers in adjacent layers.

A specific objective of the multi-directionally oriented fiber construction is to enhance the capability of transferring shear forces by means of a mechanical fastener. Increased strength in securing the reinforcing plates 10 to the wall W is effected by anchor plates 12, which preferably have a multi-directionally oriented fiber construction, and are positioned at or near the upper and lower ends of each reinforcing plate. These anchor plates comprise short lengths of rigid, fiber reinforced polymer that may be either of the same or a different construction than the underlying reinforcing plate 10.

Figure 3:
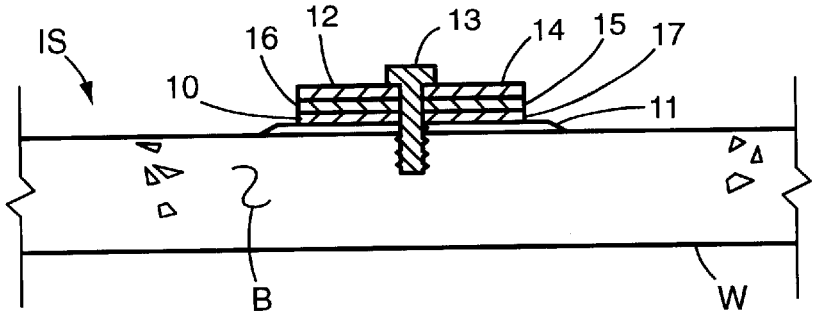
FIG. 3 is a view in section illustrating an end view of a plate as viewed along the line 3—3 of FIG. 1.

An attaching device, such as a mechanical fastener 13 adapted to be anchored into a receiving socket bored in the block B, extends through aligned apertures in the anchor plate and in the reinforcing plate 10 and extends into the underlying block B of the wall W with which it effects mechanical interconnection as can best be seen in FIG. 3.

The anchor plate of FIG. 3 includes two plate elements 14 and 15, which are of the same construction as the reinforcing plate 10. Although the anchor plate 12 includes two plate elements 14 and 15, it could include only one, or more than two, as is necessary to meet the structural strength requirements of a specific installation. The plate elements 14 and 15 may be of different thickness from one another and from the reinforcing plate 10. A bonding adhesive is placed in layers 16 and 17 between the plates to form a bonded unitary structure for enhanced strength.

Figure 4:
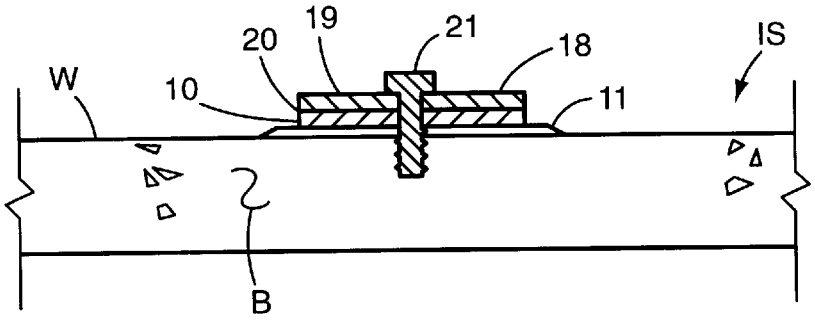
FIG. 4 is an end view in section illustrating a modified plate and anchor plate combination.

A modified anchor plate 18 is shown in FIG. 4. It comprises a single plate element 19 positioned on the exterior surface of the reinforcing plate 10 to which it is adhesively bonded by an intervening layer of bonding adhesive 20. This results in a rigid unitary structure that is secured to the underlying block B by a mechanical anchor 21 extending through aligned apertures formed in the strengthening and anchor plates and extending into the block. This provides a mechanical interconnection between the plates and the block to effect transfer of transverse shear forces. The plate element 19 may be of a construction that more effectively transfers any forces exerted transversely to the longitudinal axis of the strengthening plate 10.

As discussed above, the reinforcing plates 10 can be secured to a wall W by means of a first structural connection, such as a bonding adhesive in combination with anchor plates 12 and mechanical fastening devices 13. These fastening devices extend through aligned apertures in the plates 10 and 12 and into respective sockets bored in the underlying block B. However, there are alternative structural connections for securing the reinforcing plates to a wall. Two of these alternative structural connections are shown in FIG. 1.

A first alternative structural connection is found on the center plate 10*a,* which is secured to the wall by a plurality of the mechanical fastening devices 21 mounted at spaced intervals along the entire length of the plate, and may also be secured by an adhesive bonding agent. Each mechanical fastening device is inserted through a respective aperture in the plate and into a respective socket formed in an underlying block. The number of devices utilized in securing of a plate may be other than as is shown.

The second alternative structural connection is shown by the plate 10*b* at the right side of FIG. 1. The plate 10*b* is secured solely by an adhesive bonding agent. Of course, the type of structural plate connection utilized in any particular circumstance depends on the requirements of that situation.

Figure 20:
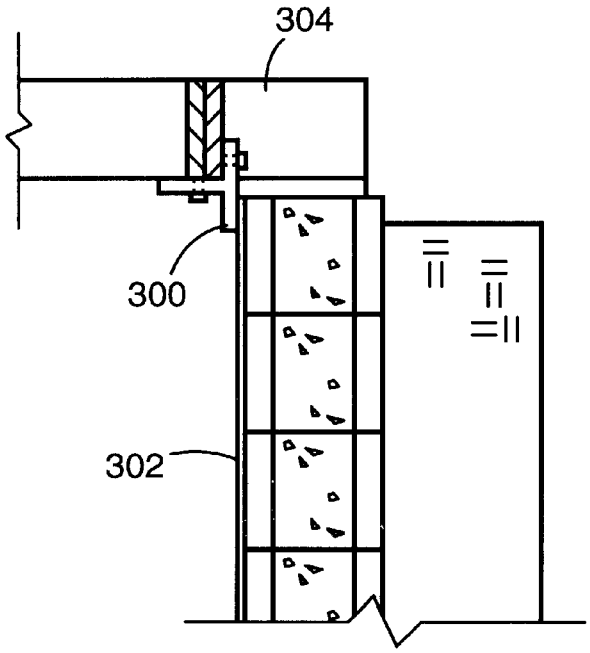
FIG. 20 is side view in section illustrating an alternative mounting means for the invention.
Figure 21:
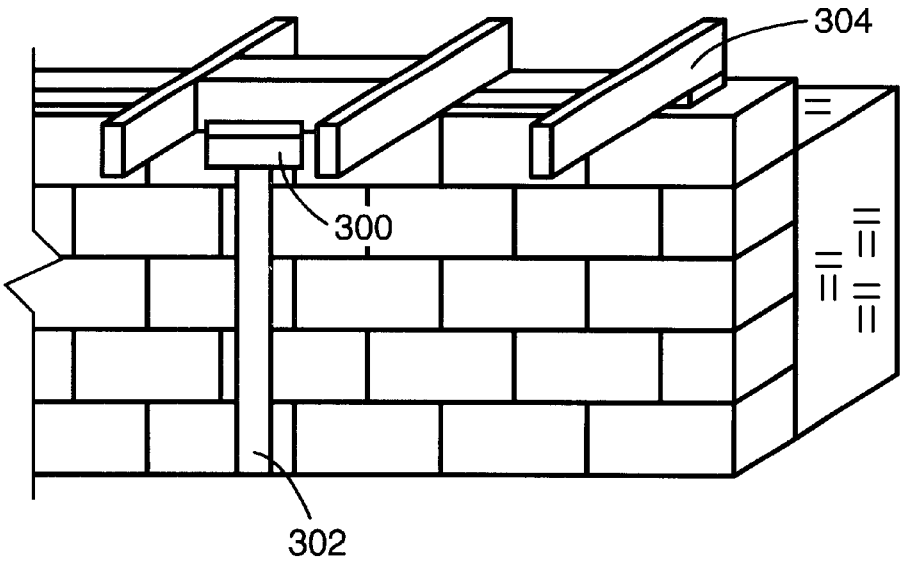
FIG. 21 is a view in perspective illustrating the element of FIG. 20.

In addition to a variety of structural connections to the wall, there are also connectors to connect reinforcing members, such as reinforcing plates, to surrounding structures. FIGS. 20 and 21 shows one such connector 300 mounted to a plate 302 and the nearby floor joist 304. The connector 300 in this embodiment is a steel "T" that is seven by fifteen by twelve inches long and is secured to the joist by bolts at each end. The connector 300 has a flange that extends downwardly from the joist 304 to seat against the upper end of the reinforcing plate 302 and hold it tight against the wall. Wooden blocks between joists may be necessary to provide a seating point with the joist 304 near the plate 302.

Of course, alternative connectors could be used, and the above connector 300 is only meant to be representative of the virtually unlimited number of structural components that will be obvious to the skilled person in view of the description herein. For example, one could use steel or composite materials of other shapes. Furthermore, one could use wooden planks extending downwardly from the joist.

In addition to the variety of structural connectors, the plate itself can have various physical configurations. A short length of a multi-layered plate 25 embodying this invention is shown in plan view applied to an underlying masonry wall W in FIG. 5. This plate 25 may be mechanically secured and/or adhered to the interior surface IS of the blocks B by a layer of bonding adhesive 26. The plate 25 is an exemplary design comprising six layers 27, 28, 29, 30, 31 and 32 of fibers that are each embedded in a respective bed 33, 34, 35, 36, 37 and 38 of a polymer matrix. All of the matrix beds are combined together into a unitary mass and cured, thus forming the plate.

Figure 5:
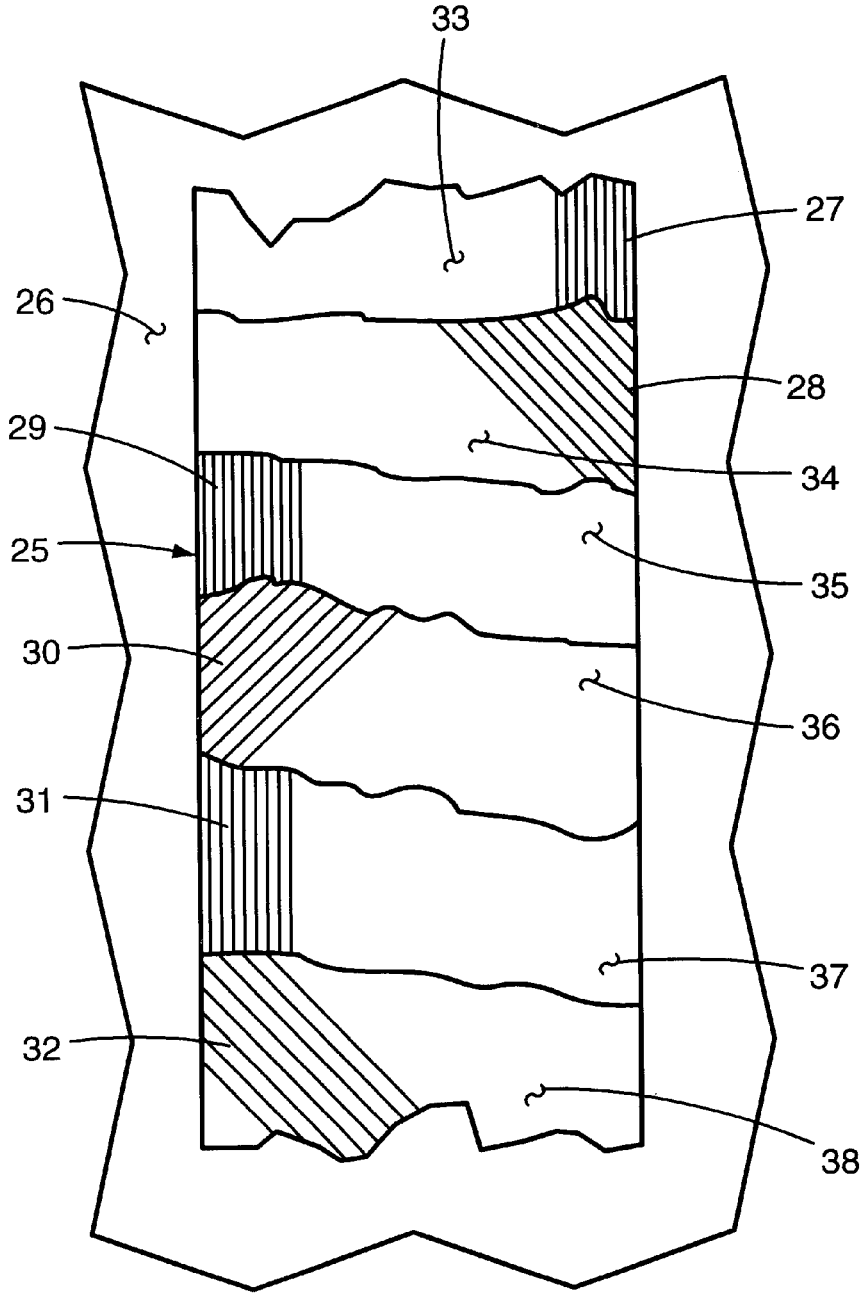
FIG. 5 is a fragmentary top plan view illustrating the plate shown in FIG. 1 with portions thereof removed for clarity of illustration.

The illustration of FIG. 5 is essentially schematic as the fibers are of extremely small cross-sectional size and can be termed as being filamentary. Each of the layers comprises multiple fibers oriented in closely adjacent, parallel relationship whereby, in combination with the polymer matrix that adhesively bonds them together into a compacted mass, they form a unitary structure.

The numbered lines in FIG. 5 represent the fibers and are intended to be illustrative of their direction of orientation in each respective layer. The fibers in each layer are unidirectional, i.e., they are all essentially parallel. These fibers are formed from carbon or glass or other suitable material having a high tensile strength.

Alternate layers of fibers are either parallel to the longitudinal axis of the plate or angularly oriented thereto at a selected angle, such as the illustrated 45-degree angle. Angularly oriented layers, such as layers 28, 30 and 32, are conveniently formed by placing short lengths from an elongated strip in adjacent coplanar relation. Their ends are cut at an appropriate angle to form an elongated strip with the ends of the short sections aligned to form an elongated strip having spaced parallel longitudinally extending edges that are aligned with the longitudinal edges of the next adjacent layer 27, 29 or 31.

While the objective of the longitudinal orientation is to enhance a plate's tensile strength, the angular orientation enhances a plate's capability to resist shear forces acting in a direction transverse to a plate's longitudinal axis or at some angle with respect to that axis. A transverse shear force is detrimental, as it tends to separate laterally the longitudinal fibers resulting in an increase in the tensile stress to which they are subjected.

In addition to providing resistance to shear forces the layers of angularly oriented fibers also provide resistance to longitudinal forces, thereby increasing the tensile strength of a plate. The number of layers of fibers forming a plate is dependent upon the tensile strength that is required for a particular wall strengthening installation. Another factor in this determination is the specific design of a particular plate, for example, the number of fibers included in a specific layer, the plate's thickness and width, and its ultimate tensile strength. A plate may include a plurality of layers as illustrated in FIG. 5, or it may have a greater or lesser number (such as even one) as is the case with a subsequently illustrated and described embodiment. Alternatively, the diagonally oriented layers in a plate may be disposed at different angles with respect to different layers of fibers in a specific plate.

Figure 6:
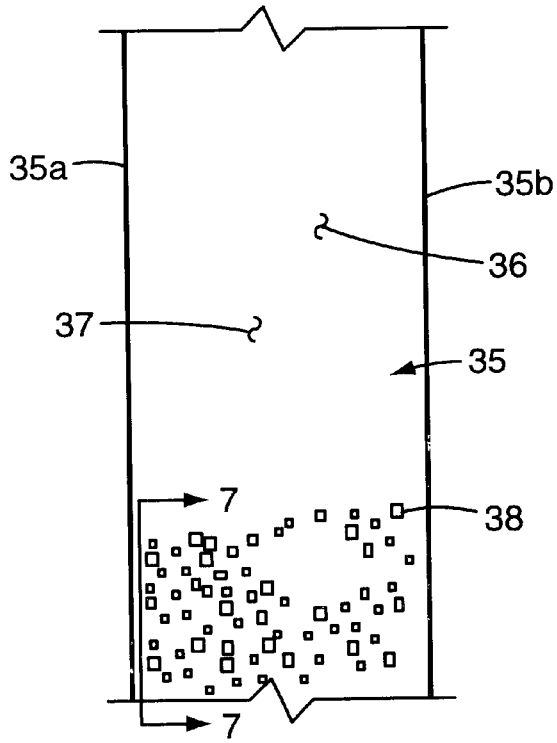
FIG. 6 is plan view illustrating a modified plate.
Figure 7:
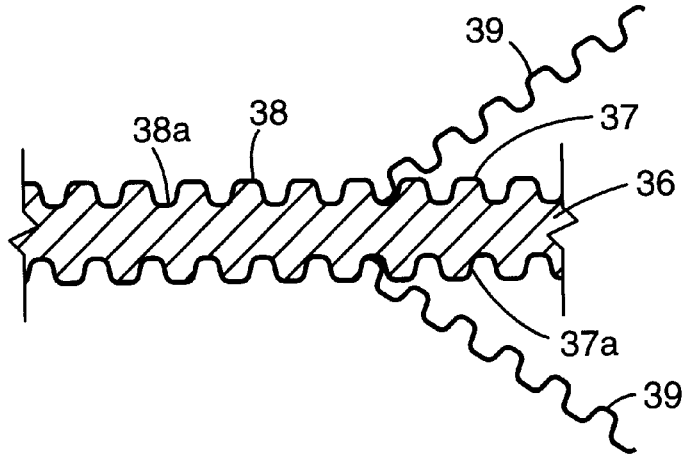
FIG. 7 is a side view in section illustrating an alternative plate viewed along the line 7—7 of FIG. 6.

A modified plate 35 is shown in FIGS. 6 and 7 and includes a fiber reinforced polymer main body 36 which is a rigid structure formed preferably by a pultrusion technique similar to that previously noted as being used in formation of the plate 10 in the FIG. 1 embodiment. Another technique that is well adapted to formation of either the preferred plate 10 or the modified plate 35 comprises placing the fibers embedded in an uncured polymer matrix in a forming cavity mold which, in turn, is placed in an autoclave. The autoclave is operated with a vacuum and sufficient heat for the period of time required to effect curing of the polymer matrix.

Regardless of the manner by which it is formed, the elongated plate 35 has spaced parallel longitudinally extending side edges 35*a* and 35*b* and a first flat surface 37 extending between those edges. The plate 35 is designed to be placed adjacent the interior surface of a wall that is to be strengthened by the plate. Integrally formed with the plate's main body 36 are a multiplicity of conically shaped protuberances 38, which project laterally outward from its flat surface 37. These protuberances are disposed in close proximity to each other and may be either dispersed in a random arrangement or they may be positioned in an orderly arrangement of spaced parallel rows that extend either transversely or diagonally across the plate's surface. Also, the protuberances in adjacent rows may be offset laterally.

In this illustrative embodiment the protuberances are of the order of 1/32 inch in diameter at their base and are of the order of 1/32 inch in height and have a rounded apex.

An objective of this modified plate 35 is that it enables use of a thick layer of adhesive bonding agent, which enhances securing of the plate to a wall. This advantage is achieved by the increased surface area created by the protuberances 38 thereby increasing the surface area to which the bonding agent can adhere. The thickness of the layer of adhesive bonding agent is at least slightly greater than the height of the protuberances to avoid contact of their apexes with the surface of the wall to which the plate is to be affixed.

The plate 35 has a second surface 37*a* disposed at the side opposite the first surface 37 in parallel relationship thereto. This second surface may also be formed with protuberances 38 of the same configuration and arranged in the same manner as those formed on the first surface.

Forming of the protuberances on both surfaces achieves two objectives. First, it effectively eliminates the likelihood of the plate curling out of its flat plane during the forming operation, an undesired action which may occur if the protuberances are formed on only one surface. Secondly, a plate having both of its surfaces provided with protuberances is advantageous when another plate is to be positioned in overlying, superposed relationship thereto. It is particularly advantageous if the additional plate has protuberances formed on its surface that is disposed in facing relationship to the second surface 37*a* of the first mentioned plate. With that arrangement it is readily apparent that the adhering surface area for the adhesive bonding agent will have been doubled.

The layer of adhesive bonding agent between the plates is preferably of a thickness to prevent contact of the opposing protuberances, either at their conical sidewall surfaces or at their apexes. It is readily apparent that the modified plates 35 disclosed with respect to the embodiment shown in FIGS. 6 and 7 are particularly advantageous in fabricating a multiple layer plate such as that shown in FIG. 5.

Forming of the protuberances 38 is accomplished by concurrently running a molding strip 39 through a pultrusion die or other forming process with the polymer embedded fibers. The molding strip is formed with sockets 38*a,* which are duplicative of the protuberances. It is preferably fabricated from a material to which the polymer does not adhere with substantial tenacity, such as the material sold under the trademark TEFLON. Thus, after the plate 35 has been formed and the polymer cured, the molding strip may be readily stripped from the plate.

Another alternative method for forming the protuberances includes providing the pultrusion die with a roller or a revolving belt aligned with the pultrusion axis. The roller or the belt is formed with sockets of a configuration to form the protuberances with the design of each respective type of forming apparatus taking into account the expected time for adequate curing of the polymer matrix.

Still another alternative method for forming the protuberances, which often results in protuberances of a smaller size than described above, includes mechanically scoring the outer surface of the plate, such as by sanding, grinding or otherwise abrading.

The reinforcing plates used in the present invention have been described in substantial detail above. In addition to the use of pre-cured reinforcing members, such as the pre-cured plates, it is also contemplated that reinforcing members can be formed in situ, that is, the composite can be formed by combining reinforcing fibers with an uncured polymer. The uncured polymer can thus serve to form the polymer matrix upon curing and to adhere the composite reinforcing member to the wall.

There are essentially two types of in situ reinforcing members contemplated: those that cover the entire wall, or substantial portions thereof, and those that are discretely spaced along the wall like the reinforcing plates described above. The former will be discussed next.

Figure 8:
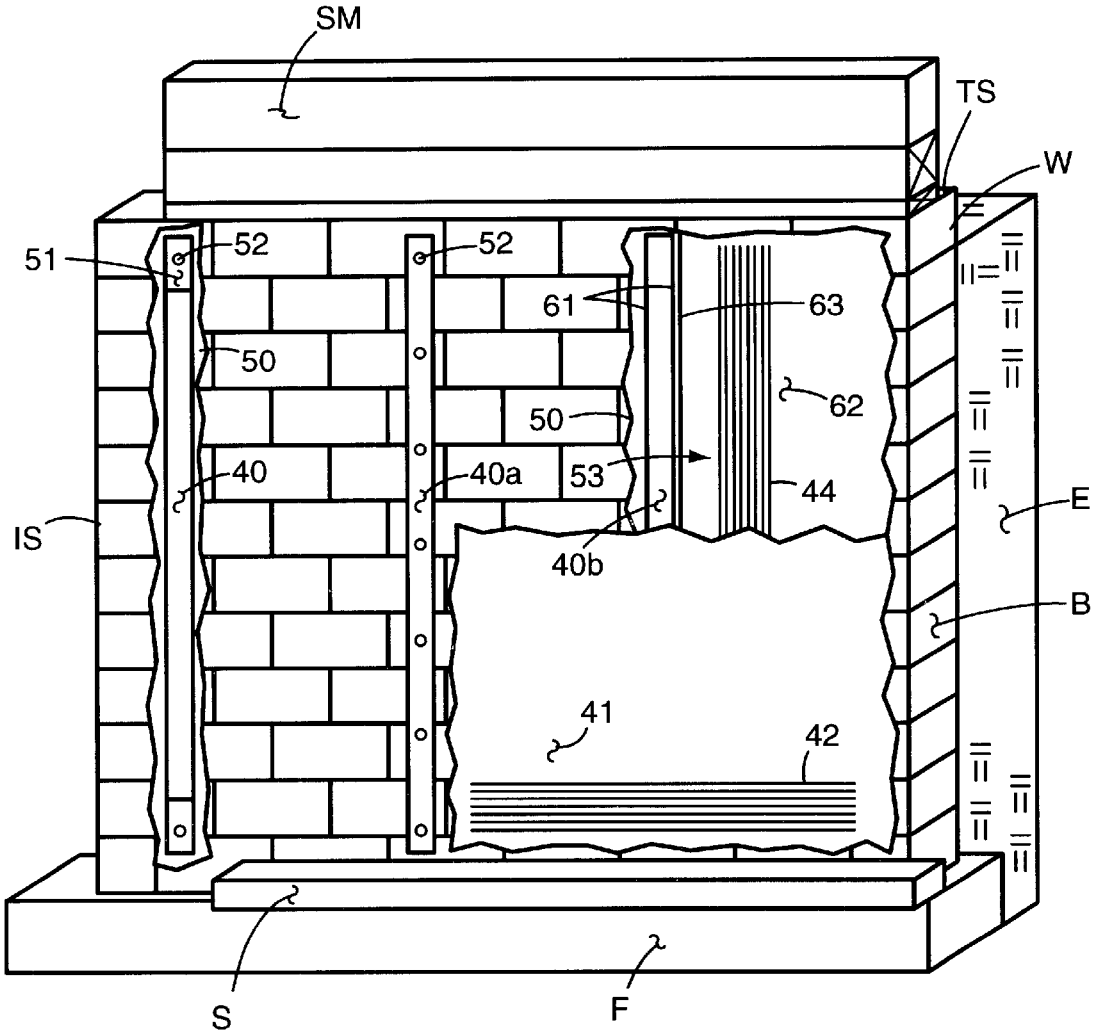
FIG. 8 is a view in perspective illustrating a wall with a strengthening plate and a waterproofing and strengthening sheet mounted thereto.

A method of strengthening a masonry wall by covering most or all of the wall W with reinforcing members is shown in FIG. 8. This wall is constructed with a plurality of modular concrete blocks B set on a footer F formed of concrete at the bottom of an excavation for a building structure. It has an interior surface IS of predetermined height terminating in a top surface TS extending around the perimeter of the building structure and on which the building's base structural member SM rests and is secured to the wall. The blocks B form an exterior surface (not shown) abutting the exterior mass of earth B which it retains by resisting the horizontally directed forces generated by the weight of the earth along with that of any ground water contained therein and directed laterally against the wall and tending to push it inwardly of the building's excavation.

Strengthening of a wall by this method is achieved by the combined effects of two distinct components. These components cooperatively provide waterproofing to the wall and provide vertically oriented tensile strength to the wall.

One of the two components is a plurality of elongated rigid, fiber reinforced plates 40, 40*a* and 40*b* vertically disposed in spaced parallel relationship similar to the embodiment shown in FIG. 1 and described with respect thereto.

The second component is a thin waterproofing sheet 41 that overlies the plates and the entire interior surface IS of the wall to which it is adhered. This waterproofing sheet is of a construction having substantial tensile strength and is oriented on the wall so that its tensile strength enhancing feature is oriented in a vertical direction. The sheet is made of high strength carbon or glass fibers. The fiber sheets, because they are flexible prior to being bonded in a polymer matrix, can be used to form a composite on curved walls.

The sheet 41 extends the full height of the wall and therefore provides complete waterproofing of the wall and aids in strengthening the wall throughout its entire length. It is to be understood that only a relatively short length of a wall is shown and a conventional residential basement wall would be of a length requiring more than two rigid, fiber reinforced polymer plates with their transverse sectional configuration and size along with their lateral spacing based on the strengthening required for a specific wall.

Application of any of the above or below described strengthening systems are initiated by first preparing the interior surface IS of the wall W. This requires thoroughly cleaning the surface to remove dirt, grease and all particles of the concrete modular blocks B or paint that may not be securely adhered to the wall. This can be accomplished by mechanical and/or chemical means well known in the industry for cleaning block. In addition, any projections of concrete from the blocks and any mortar that may have inadvertently been applied to surfaces of the blocks must be removed. Finally, the wall must be roughened, if it is not already, to the texture of a course sandpaper. For example, if the wall is made of glazed block, the glazing must be removed or roughened.

Mortared joints between blocks must be smoothed to remove outwardly projecting components of mortar and to fill in holes that may exist in the joints and the blocks' surfaces to produce a smooth surface. A smooth surface is desired to avoid possible voids between the wall and the plates or the waterproofing sheets. Such voids could be created if there is not sufficient adhesive applied to assure a continuous bond. A smooth surface also avoids puncturing of the sheets. Additionally, cracks in a wall must be repaired to further reduce the chance for water leaks. Preparation of the wall's interior surface as described is important to better assure secure attachment of the strengthening and waterproofing components to the wall.

Next, the rigid, fiber reinforced polymer plates 40 are cleaned. Preferably, acetone is used to clean the plates 40 to remove dust, grease or other residue. The plates 40 should also be sanded, or otherwise abraded, on at least one major face to enhance bonding with the adhesive.

Figure 15:
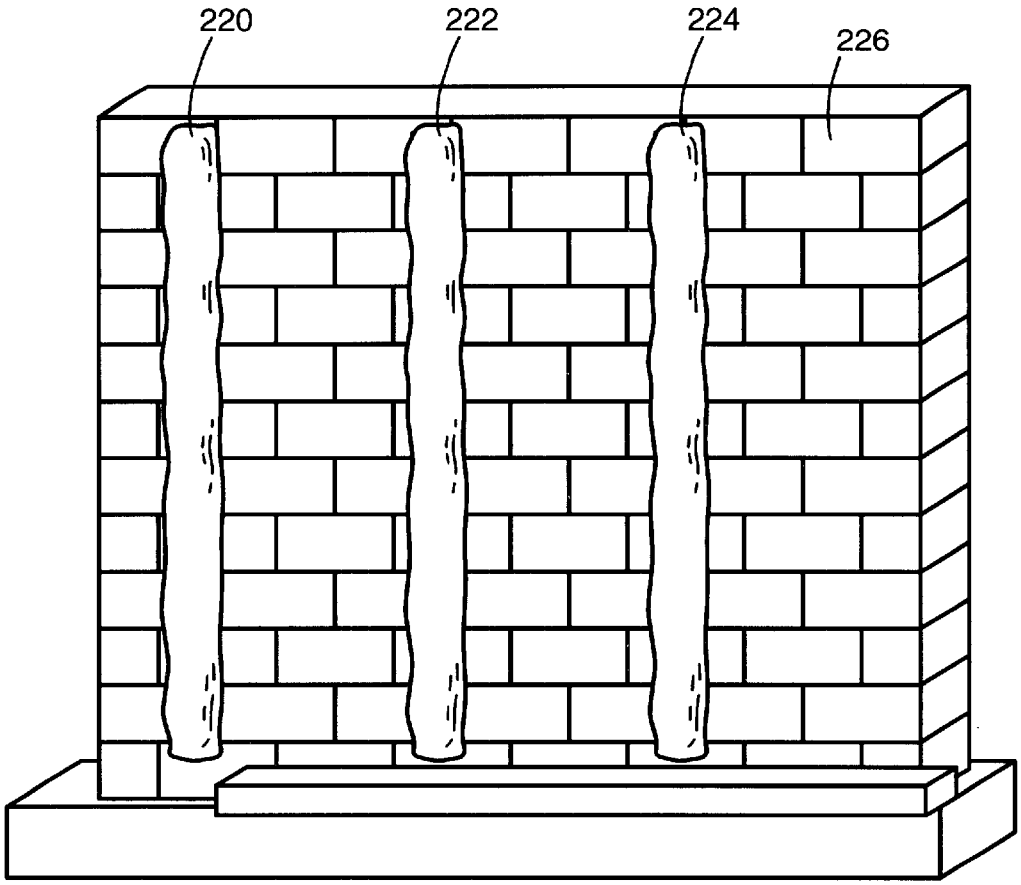
FIG. 15 is a view in perspective illustrating a wall with paste strips thereon.

Before the plates 40 are affixed to the wall W, a layer of bonding adhesive 50 is applied to the wall, or alternatively to the plate or both, in a strip that is at least equal in width to that of the plate and extending the full length of the plate. This is shown in FIGS. 1 and 15.

The strip of paste, when applied directly to the wall, fills in any pores, holes or gaps, and sand can be added to the paste to form a mortar. The strip of paste can be sanded or otherwise abraded to smooth it. A plate 40 is then placed in aligned relationship with the strip of adhesive and firmly pressed against it to effect bonding.

Although the plates are shown as extending the full height of the wall, they may be of a lesser length and extend from the floor slab S to a height that is level with the top of the earth E. Alternatively, the plates may be extended to a point where the lateral forces exerted by the earth are of little or no consequence.

Anchor plates 51 are also applied, where necessary, to the upper and lower ends of the reinforcing plates 40 to provide additional strength in securing of the reinforcing plates to the wall. As described with respect to FIG. 1, application of the anchor plates is a strength-enhancing option that is effected by means of a bonding adhesive applied to the surfaces of each anchor plate that is to be placed in contacting engagement with each other anchor plate or the strengthening plate. A securing device 52 is inserted through the aligned apertures in the plates and projected into an underlying block B.

Application of the sheet 41 for waterproofing and strengthening of the wall is next initiated. First, a layer of saturating adhesive 53 is applied to the wall's interior surface IS. The adhesive is preferably applied to sections of a wall. Alternatively, or in addition, the saturating adhesive could be applied to the sheet.

When applied to the wall, the saturating resin is applied in sequential increments beginning at one end of the wall, or another selected starting point, rather than to the entire wall at one time. This minimizes the time that any portion is not in engagement with a respective portion of the sheet, thereby limiting the time of exposure to air, which will initiate curing.

A sheet 41 is provided in a roll of selected length and of a selected width to cover the entire wall above the floor slab S. An end edge of the roll is placed in vertical alignment with the end of the wall, or any other selected starting point. With the end edge of the sheet perpendicular to its longitudinal side edges, that edge adjacent the floor slab will closely follow the bottom edge of the exposed portion of the lower tier of blocks thus assuring that the wall's surface will be entirely covered with the waterproofing sheet. The roll of the sheet 41 is unrolled to the extent necessary to substantially cover the wall section to which adhesive had been applied.

As the portion of the sheet is adhered to the wall, the sheet is pressed tightly against the wall's surface and into the saturating adhesive 53. Some adhesive is likely to extrude through any interstices between adjacently disposed fiber tows, thereby assuring that the tows form a continuous, uninterrupted sheet.

A roller may be used to assist in applying sufficiently uniform pressure by causing the roller to traverse the sheet, thereby causing the sheet to be pressed into the layer of resin and thereby resulting in some of the resin being forced through the interstices of the sheet. The amount of resin extruded through the interstices assures that the fibers forming the sheet will be bonded together in addition to being thoroughly adhered to the wall. Rolling is continued until the sheet in fixed in position. Additional bonding resin may be applied to the outer exposed surface of the sheet and rolled thereon to further assure filling the interstices in the fibers thereby enhancing their bonding. This not only increases the waterproofing ability of the sheet but it enables the sheet to have a smooth exterior surface, which facilitates cleaning in addition to enhancing aesthetic appearance.

This process is sequentially repeated until the entire wall is covered. Since the fiber tows forming the sheet 41 are not initially rigidly interconnected along their adjacently disposed longitudinal edges, the sheet will readily flex into conformance with the surfaces of a strengthening plate 40.

There is alternative method for mounting the waterproofing sheet 41 shown in FIG. 8. Instead of mounting the sheet 41 over the plates 40*a,* 40*b* and 40*c,* the sheet 41 can be mounted in sections between the plates. For example, a waterproofing sheet 62 of the same construction as that of sheet 41 previously described is shown applied to the wall's interior surface IS. In this embodiment the sheet 62 is only applied to the wall's surface and does not extend over the plates 40*a,* 40*b* and 40*c.* Each section of the sheet 62 extends only between adjacently disposed plates with the edges of the sheet abutting the respective lateral edges 61 of each plate. These sheet sections 62 are secured to the wall by a bonding resin in like manner to the sheet 41.

The waterproofing sheets 62 and 41 are shown with fibers oriented at right angles to one another. Of course, the fibers could be oriented at any selected angle. The sheets form a unitary, two-layer sheet that, in addition to enhanced waterproofing capability, improves the mechanical strengthening of the wall W.

A particular advantage of the structure shown in FIG. 8 is its capability of strengthening the wall to counteract horizontal stress forces that can result from lateral forces applied to the wall's exterior surface between any pair of adjacent plates 40. While a wall is initially designed and constructed to withstand a predetermined lateral force that is customarily expected at the location of the building, those forces may change over a time. A subterranean wall, such as a basement wall, is often subject to deterioration that weakens the wall to an extent that cracks may develop, resulting in a greater likelihood that inward bowing of the wall may occur. Such bowing leads to more rapid deterioration.

Figure 9:
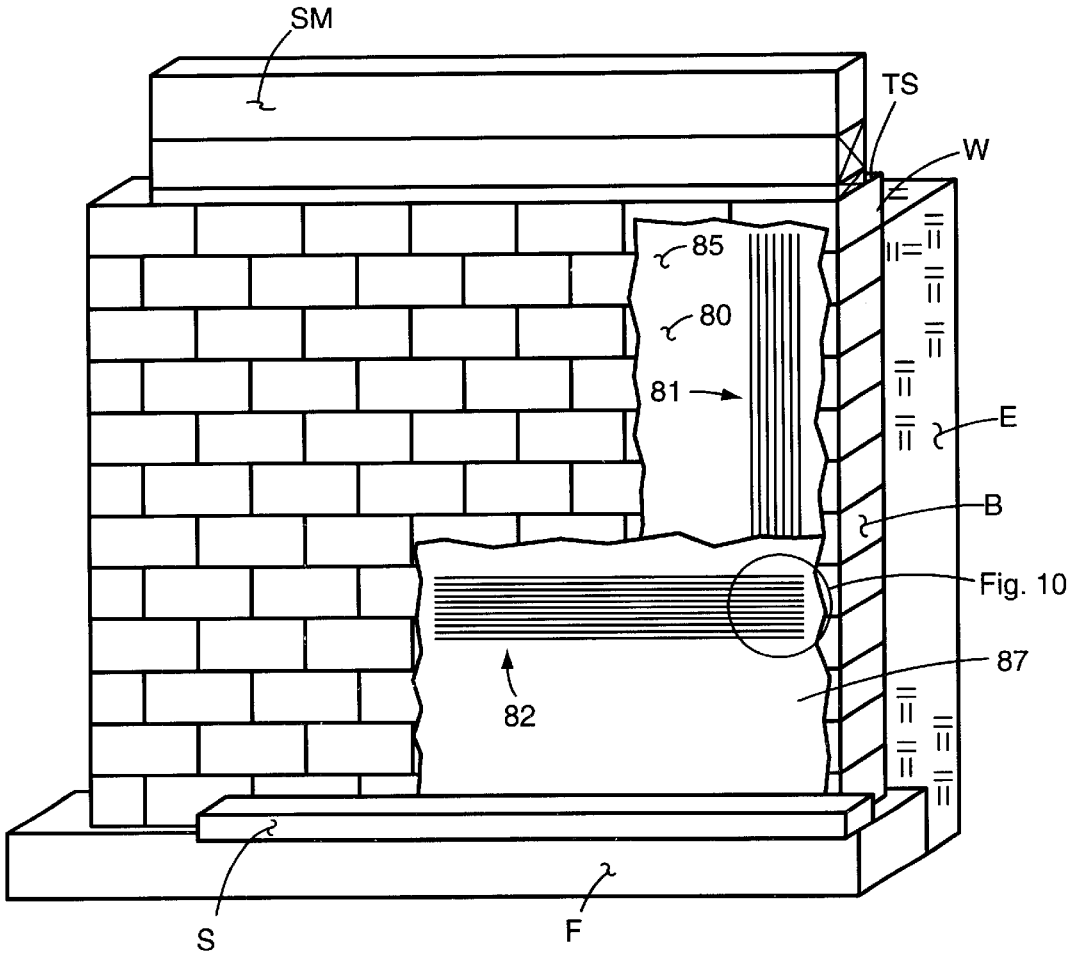
FIG. 9 is a view in perspective illustrating a wall with a strengthening plate and a waterproofing and strengthening sheet mounted thereto.

Another alternative embodiment of the wall reinforcing method of the invention is illustrated in FIG. 9. This alternative embodiment is used with a wall W incorporating the basic structure of the walls which have been previously illustrated and described. In this alternative embodiment the wall is not provided with a plurality of rigid, fiber reinforced polymer plates 10 attached to its interior surface IS by a bonding adhesive. This embodiment of the invention utilizes only strengthening and waterproofing sheets 80 which are secured to the interior surface of the wall. The sheets are of a length to extend from the floor slab S to the top surface TS of the wall or to a lesser height for reasons previously discussed with reference to other embodiments of this invention.

Reinforcing of the wall in accordance with this embodiment is provided by a sheet 80, shown in FIG. 9. that, in its original state, is of a dry, flexible construction having characteristics of a woven fabric similar to the sheets 41 and 62 described in association with FIG. 8. This sheet thus exhibits a fabric's characteristic porosity that is adaptive to receiving a saturating resin bonding agent of heavy oil-like consistency in its interstices thereby enhancing its ability to be secured to the surface of the wall.

Figure 10:
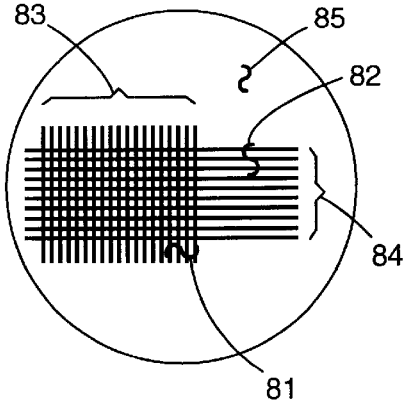
FIG. 10 is a plan view illustrating the sheets shown in the encircled region designated FIG. 10 in FIG. 9.
Figure 11:
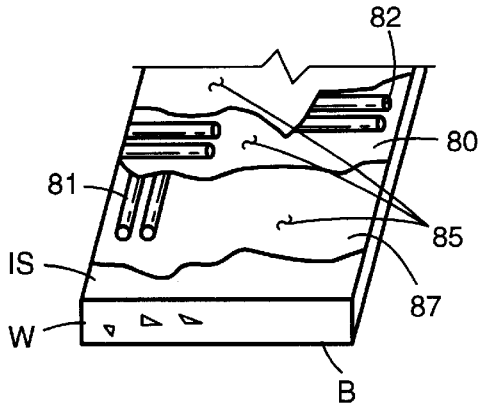
FIG. 11 is a view in perspective illustrating a portion of the strengthening and waterproofing sheets shown in FIG. 10 with portions thereof broken away for clarity of illustration.

FIG. 9 illustrates the basic structure of the sheets 80 and 87 schematically, and its structure is shown in greater detail in FIGS. 10 and 11. The fibers of the sheet 80 are disposed in superposed relationship oriented at right angles to the fibers of sheet 87. The two layers of respective tows 81 and 82 embedded in the adhesive bonding resin ultimately join into a unitary structure with the adhesive forming the matrix.

Before adhering the sheet 80 to the wall, the wall must be cleaned and prepared in accordance with the technique previously described. Then, a saturating bonding resin is applied either to the wall, or the sheet or both. Next, the sheet is forced against the wall as described above for the sheets 41 and 62 of FIG. 8.

It is, of course, possible to combine a second sheet 87 with the sheet 80, forming a layered reinforcing member. The sheets are structurally independent, flexible sheets comprising a plurality of tows held in closely adjacent, parallel relationship by a number of interwoven filaments disposed in relatively closely spaced relationship. A layer of the saturating adhesive bonding agent is spread on the wall's interior surface IS, and a sheet of the dry fabric is pressed into the adhesive. Alternatively, the saturating adhesive can be applied directly to the sheet.

If only one sheet 80 is mounted to the wall, it is oriented with the fiber tows 81 disposed vertically to obtain their tensile strength in strengthening of a wall. Additional resin is then placed on the exposed outer surface thereby completing formation of the sheet. Where two sheets 80 and 87 are used, as shown in FIG. 9, the second sheet 87 is advantageously positioned with its fabric flexible sheet oriented with its tows horizontally disposed to counteract forces encountered by the first sheet 80 that had been applied to the wall. Application of the second sheet 87 proceeds in the same manner as the first sheet 87.

Figure 12:
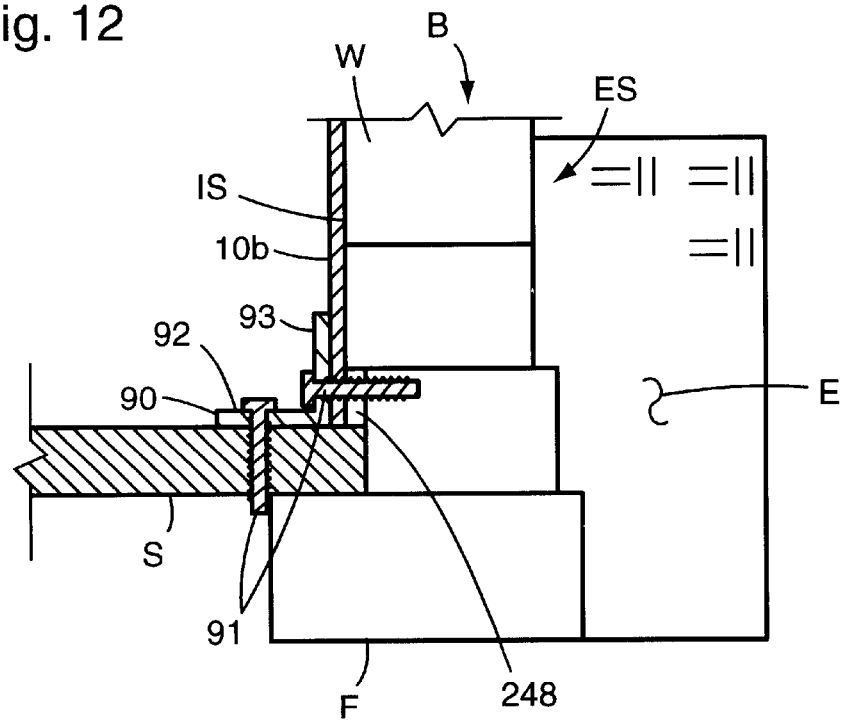
FIG. 12 is a side view in section illustrating the mounting bracket viewed along the line 12—12 of FIG. 1.
Figure 13:
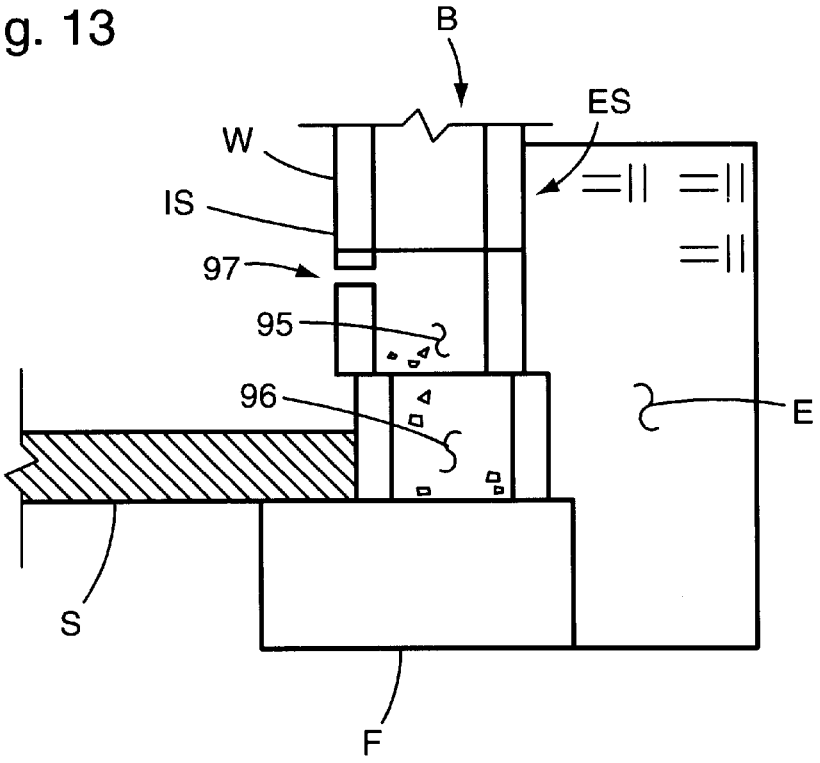
FIG. 13 is a side view in section illustrating a bottom portion of a masonry wall showing a reinforcing technique for a wall that has incurred damage resulting from excessive lateral force applied to the wall's exterior surface.

In addition to the methods of reinforcing walls, there are additional structures that can further be added to the above described structures. A common failure that occurs with concrete block masonry walls W is shown in FIGS. 12 and 13 with two structures for correcting the associated problem. These correcting structures are designed to be used in conjunction with the wall strengthening methods and structures described above.

The failure in the wall occurs as a consequence of the lowest row of blocks B abutting the floor slab S, which aids that row in resisting the horizontal forces exerted laterally inwardly against the exterior surface ES of the wall. But the remaining, upper rows of blocks do not have the benefit of the floor slab's counteracting support, and therefore it is possible that these remaining rows of blocks may be displaced inwardly as is shown in FIGS. 12 and 13. This is particularly true with older wall constructions. Newer construction techniques tend to avoid this problem by filling the interior cores of the blocks with concrete.

Figure 19:
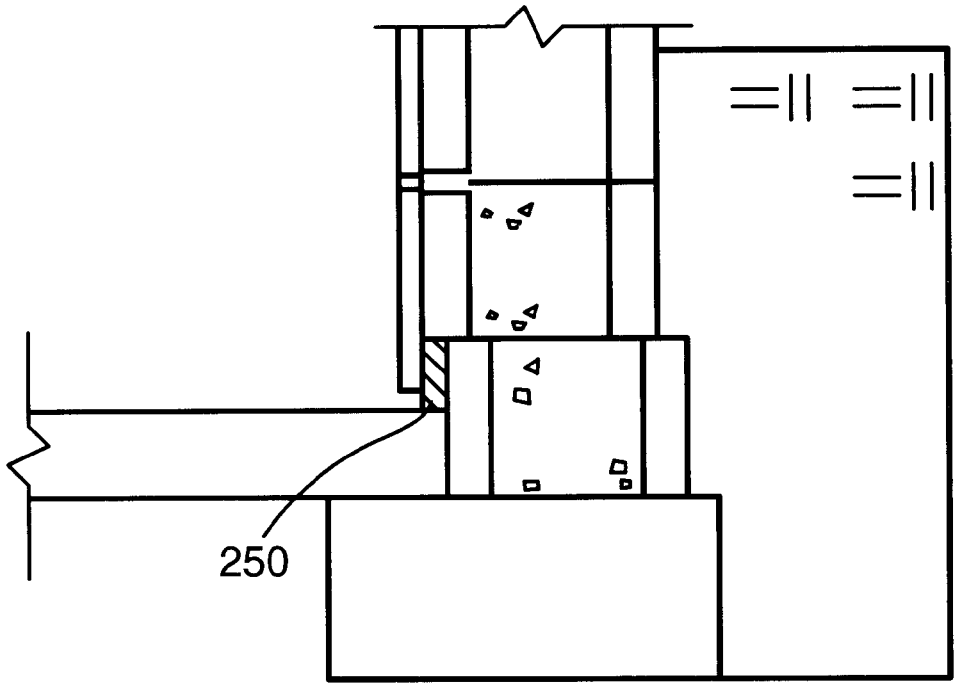
FIG. 19 is a side view in section illustrating an additional element of an alternative embodiment.

Referring to FIGS. 1 and 12, a method for preventing this defect from permitting further damage is illustrated and is hereafter described. The plate 10*b* is formed to a length whereby its lower end terminates below the bottom edge of the block B in the second row of blocks, forming a cavity 248. Additional reinforcement and strengthening is provided by an L-shaped brace 90 placed in this region. The brace 90 has a first leg 92 positioned on and secured to the floor slab S by fastening devices 91. The second leg 93 of the brace 90 extends a distance upwardly in parallel relationship to the wall's interior surface IS and overlaps the lower terminal end of the plate 10*b*. Fastening devices 91 are projected through the leg 93 of the brace 90 and into the underlying block B. Strengthening and waterproofing sheets 80 such as is shown in FIG. 9 may be utilized in combination with the brace 90. As shown in FIG. 19, the gap 248 between the back of the plate 10*b* and the wall can be filled with an epoxy mortar 250 made of sand and epoxy paste.

FIG. 13 illustrates an alternative method for preventing the spread of this type of wall damage and to aid in reinforcing and strengthening a modular concrete block wall W. A grouting 95 is introduced into the cores 96 of the lowermost two tiers of blocks B where it solidifies. Holes 97 are bored through the sidewalls of the blocks for introducing the grout into the block's cores.

Throughout the foregoing descriptions of the several embodiments of this invention the term "bonding adhesive" has been used in a generic sense to designate a material that is utilized in securing the reinforcing fibers in forming the reinforcing plates as well as securing those plates to a wall. It is also used to designate the material used in securing other components together in forming the sheets that are applied to the wall surfaces to provide strength in addition to waterproofing the walls.

This bonding adhesive may be of any of the several commonly available polymers such as epoxy, polyester or vinylester, for example. However, it is to be understood that these are exemplary and not to be considered limiting in the particular adhesive which is utilized in a particular installation. Since the walls that are to be reinforced or strengthened by employment of this invention are vertically oriented, it is preferable that the bonding adhesive be of form or have a consistency that prevents or at least limits downward flow of the adhesive on the wall during the time of application of the plates or sheets.

Utilization of the above described reinforcing and waterproofing apparatus and method is not limited to masonry structures or to vertical walls of such structures. It may also be utilized with wood and metal structures, or structures fabricated of other materials, giving appropriate consideration to the mechanical characteristics of the particular material.

From the foregoing description of the several embodiments of this invention considered in conjunction with the accompanying drawings it will be readily apparent that a greatly improved wall strengthening apparatus and method is disclosed. Additionally, some of the embodiments incorporate waterproofing features that can function independently of other wall strengthening components or can be used in cooperation with such components to enhance the wall strengthening capabilities. The rigid, fiber reinforced polymer plates provide significant tensile strength as a consequence of being fabricated with fiber strands of high tensile strength, such as carbon or glass or other filamentary material exhibiting similar high tensile strength characteristics. The wall strengthening capability of this system is greatly enhanced through combination of the plates and the waterproofing sheets. This capability is further increased through combination of two waterproofing sheets disposed in overlying relationship.

An additional process for reinforcing a wall is described below with reference to FIG. 14. A conventional wall 200 has a vertical groove 202 sawed into it, forming a groove floor 204 and sidewalls 206 and 208. The wall 200 is a solid concrete wall, whether poured or a filled modular block wall.

A bar, and preferably the three-eighths inch or smaller diameter FRP composite rod 210, is inserted in the groove 202 after an adhesive 212 is injected into the groove 202. The rod 210 displaces some adhesive, forcing the adhesive outwardly against the groove floor 204 and sidewalls 206 and 208. An interface is formed between the adhesive 212 and the circumferential exterior surface of the rod, causing adhesion when the adhesive cures. For this reason the rod may be abraded, such as by sanding or grinding, prior to installation to improve the adhesion. The adhesive is preferably smoothed at the opening to the groove to form an outer adhesive surface 214 that is flush with the interior surface 216 of the wall, thereby forming a continuous interior wall surface.

The groove 202 is approximately one-eighth of an inch wider and deeper than the rod's width, causing the rod 210 to be completely encapsulated within the adhesive 212 and permitting a continuous surface to exist on the interior of the wall once the adhesive is cured.

Alternatively, though not shown, the groove could be substantially deeper than the rod's width. However, a deeper groove creates an increased likelihood of so weakening the wall that it forms a preferred fracture point for the wall. A still further alternative is that the groove's depth could be the same as or less than the rod's width, but then the risk exists that the rod will improperly adhere to the wall due to too little interface between the adhesive and the rod.

An alternative to forming a groove by cutting the block is by removing mortar from a joint between blocks in a modular block wall. This has the potential disadvantage of significantly weakening the wall, but may be applicable in some instances, such as when the voids in a modular block wall have been filled with concrete.

An alternative to a circular cylindrical rod shown is a bar having a cross sectional shape that is not a circular cylinder, but is a cylinder of another curve, such as an oval, a rectangle or an I-beam shape. The listing of these shapes is not intended to limit the number of shapes that are applicable, but instead is only to serve as examples of an almost limitless number of shapes possible.

Figure 14:
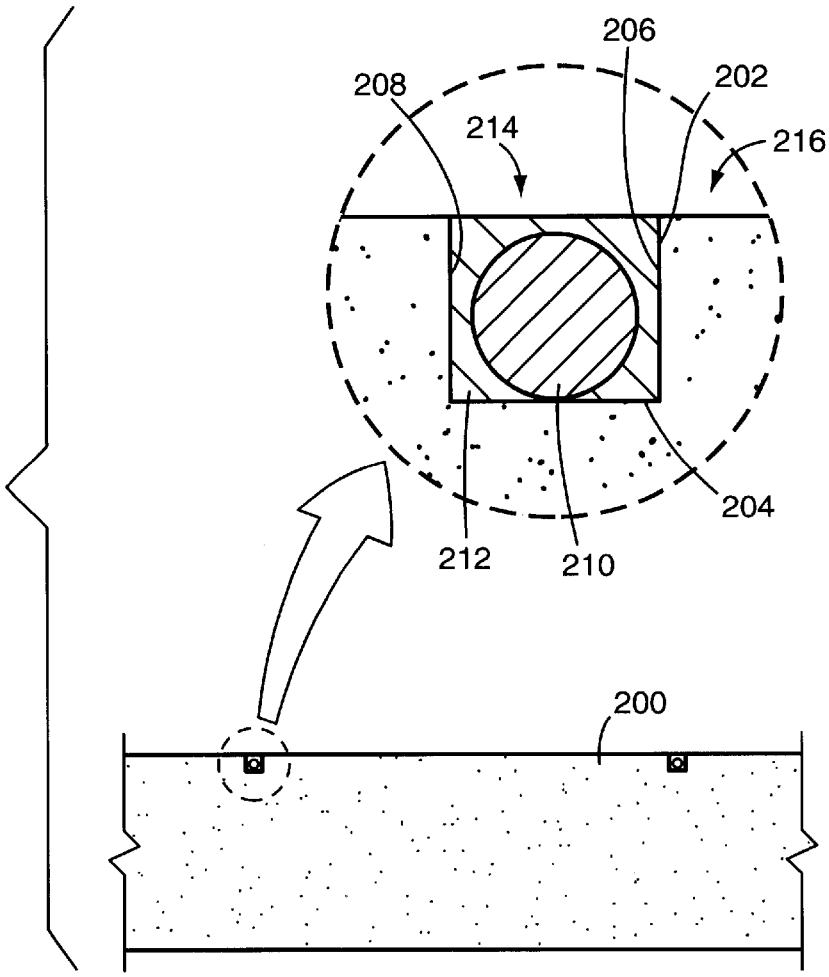
FIG. 14 is a top view in section illustrating a wall in which grooves are formed into which reinforcing bars are adhesively mounted.

As described above for the reinforcing plates and the fabric strips formed in situ, the rods shown in FIG. 14 are spaced according to the parameters of the wall and the surrounding environment.

Figure 17:
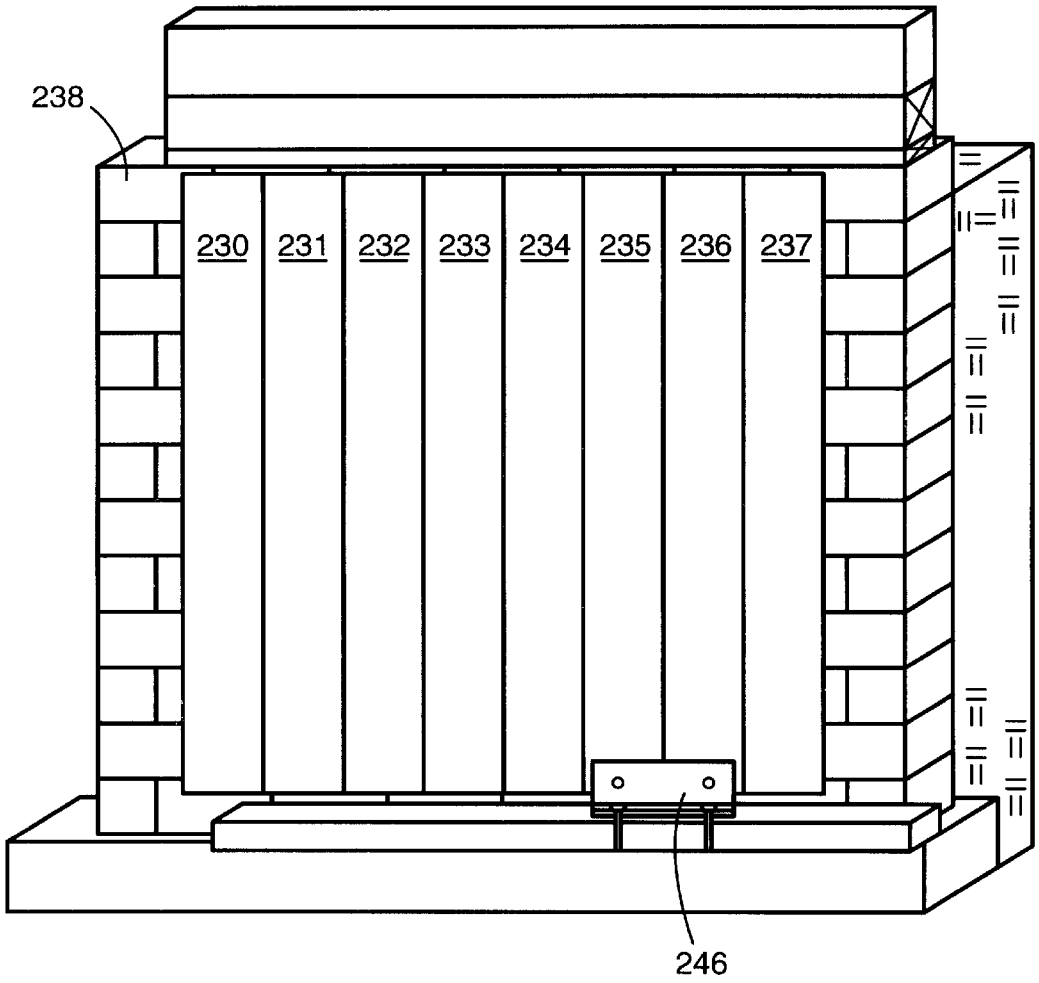
FIG. 17 is a view in perspective illustrating a wall and abutting opposing lateral edges of the plates.

A further alternative to spacing pre-cured plates on the wall is the mounting of pre-cured plates directly adjacent one another, i.e., with lateral edges abutting one another. This is shown in FIG. 17, in which a plurality of pre-cured plates 230–237 are mounted to the wall 238 in the same manner described above with reference to FIG. 1. Either the major faces of the plates 230–237 or the surface of the wall, or both, are coated with adhesive paste and then forced together. Once the paste adhesive cures, the plates are mounted to the wall, thereby reinforcing it.

Unlike the plates of FIG. 1, however, the plates 230–237 are mounted to the wall 238 with their opposing lateral edges abutting the next adjacent plate. Of course, the plates 230 and 237 at opposite ends of the wall 238 do not have an adjacent plate abutting one of their opposing lateral edges. However, by abutting all of the plates that have a neighbor plate, the wall 238 is waterproofed and reinforced. And because of the lack of spacing between them, the pre-cured plates 230–237 do not need to be as strong as the spaced plates described above in relation to FIG. 1.

Figure 18:
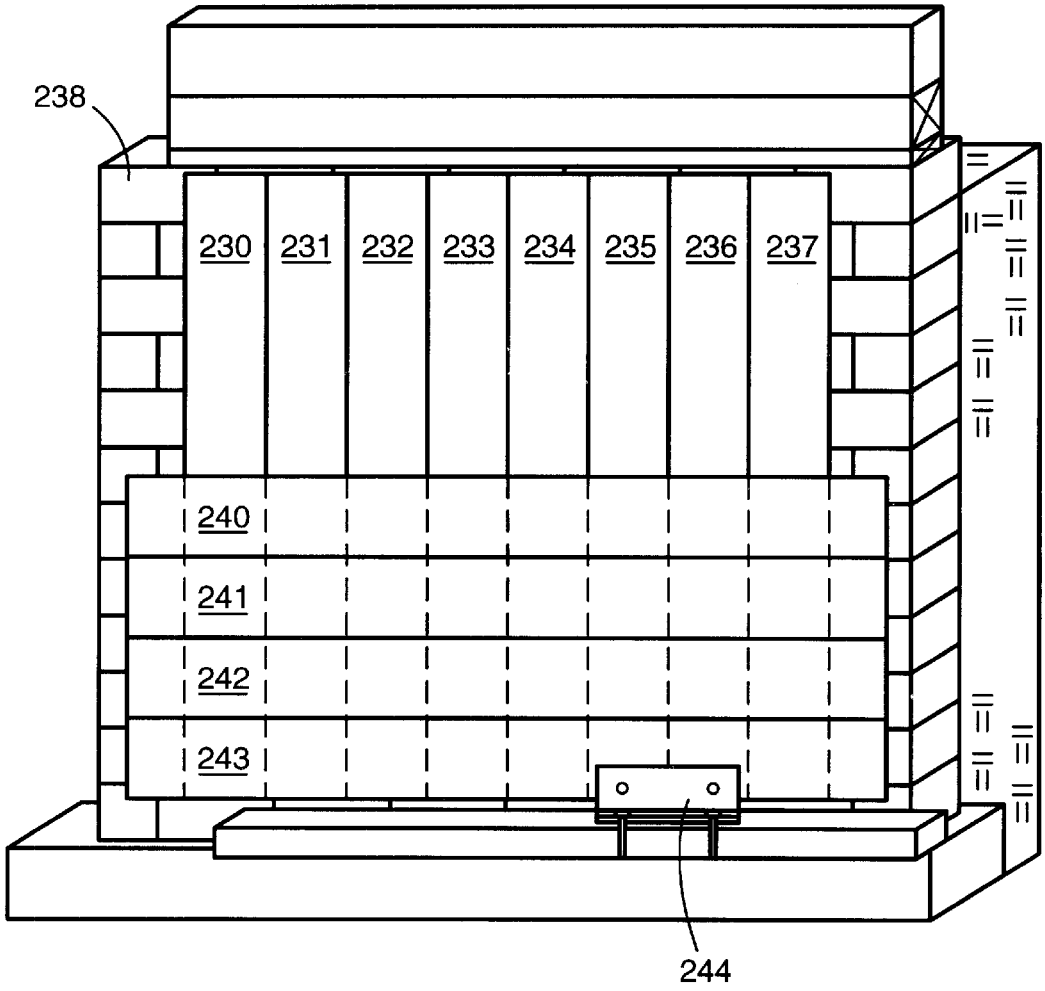
FIG. 18 is a view in perspective illustrating a wall reinforced by adhering pre-cured plates vertically thereto and abutting opposing lateral edges of the plates, and additional plates mounted transversely to the vertical plates.

Furthermore, as shown in FIG. 18, pre-cured plates 240–243 can be mounted transversely to the vertically mounted plates 230–237. The horizontal plates 240–243 are mounted to the wall 238 by applying adhesive to either the major faces of the horizontal plates 240–243 or the outwardly facing major faces of the vertical plates 230–237 or both. Then the horizontal plates 240–243 are forced against the vertical plates 230–237 with the opposing lateral edges of the horizontal plates 240–243 abutting one another. The horizontal plates 240–243 provide further waterproofing, but more importantly provide structural support to the wall in a horizontal direction. Of course, the plates 230–237 and the plates 240–243 could be oriented other than vertically and horizontally to provide support in any direction needed.

Figure 2:
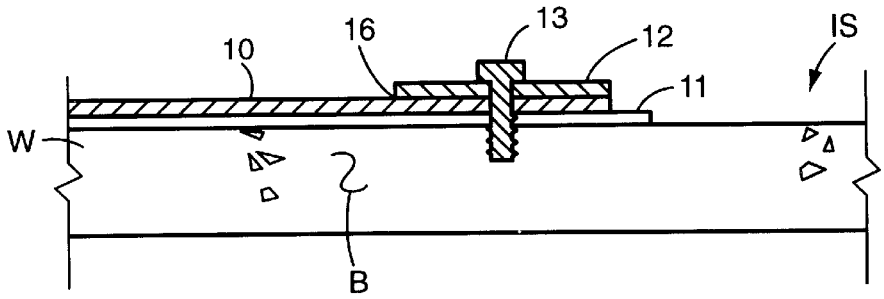
FIG. 2 is a side view in section illustrating a side view of a plate as viewed along the line 2—2 of FIG. 1.

In addition to the pre-cured plates shown in FIGS. 17 and 18, wall supports 244 and 246 can be mounted at the intersection of the floor and the wall to further reinforce the plates' attachment to the wall as described above with respect to FIGS. 2 and 12.

There is a problem with forming a composite reinforcing member in situ on a wall, as opposed to adhering a pre-cured plate to a wall. The problem arises from the fact that during the forming process of the former, a saturating adhesive is applied to saturate the reinforcing fibers woven into a fabric. The whole structure is placed against the wall, and some amount of the adhesive absorbs into the wall.

The saturating adhesive may be of such low viscosity that a large amount of it soaks into the porous surface of the wall. Of course, there must be some absorption of the adhesive into the wall in order for proper adhesion to occur, but when absorption occurs to too great an extent, the amount of adhesive in the fabric decreases due to capillary action and becomes too low. This results in "starving" the fabric of the adhesive that is necessary to form the matrix that the fabric reinforces. Without the proper matrix, the composite is substantially weaker.

The viscosity of the saturating adhesive has a maximum above which the adhesive will not properly wet the fabric. Therefore, the viscosity of the saturating adhesive cannot be significantly higher than this threshold because, although it will have a decreased tendency to absorb into the wall, it will also have a decreased tendency to absorb into the fabric. The preferred saturating adhesive is a two part amine based epoxy mixed at a 4:1 ratio, having a viscosity less than or equal to about 20,000 cps. Of course, there may be other adhesives that are mixed at a different ratio to achieve a similar viscosity.

A method has been conceived to reduce or eliminate the absorption of adhesive into the wall without decreasing the ability of the adhesive to saturate the fabric. In one embodiment shown in FIG. 15, a much thicker (i.e., higher viscosity than 20,000 cps,) paste adhesive is applied to a wall 226 in strips 220, 222 and 224. These strips are wider than the fabric strips that will be forced against the wall after the lower viscosity saturating adhesive is applied to the fabric strips.

The preferred paste adhesive is a two part amine based epoxy at a 1:1 mixture having a viscosity greater than about 20,000 cps. Again, the mixture ratio could vary. The paste adhesive, which is preferably spread along the wall to form a strip, infiltrates the pores of the wall 226 and adheres thereto, but has too high of a viscosity to wick further into the wall 226 by capillary action. Thus, it levels the wall and reduces its porosity, while still providing substantially the same adhesive properties. Paste adhesive is ordinarily formed from a lower viscosity adhesive into which a thickening agent or material is added. For the present invention, a paste adhesive is defined as any adhesive with a viscosity greater than 20,000 cps, whether the viscosity is raised by adding chemical thickening agents or particulate, such as powder, silica or sand, to thicken a lower viscosity adhesive. This is often called a grout in the industry.

Figure 16:
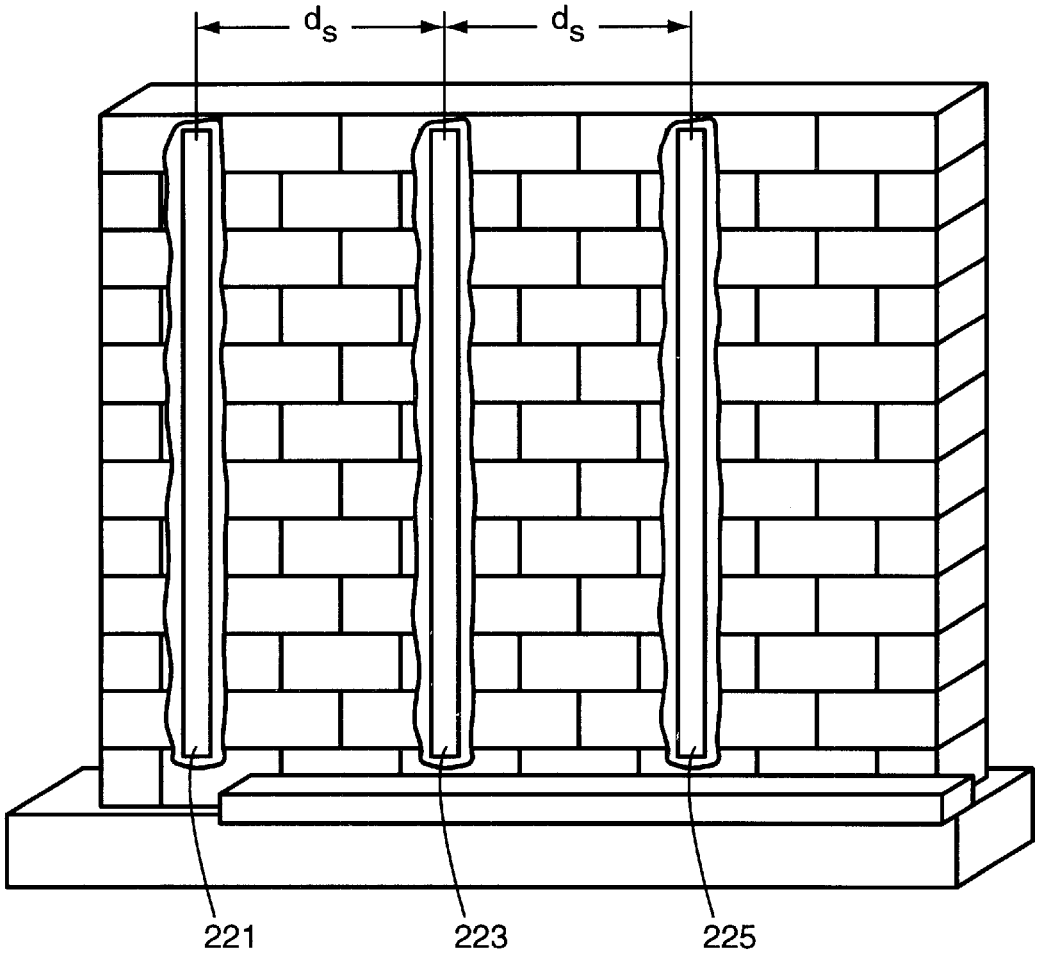
FIG. 16 is a view in perspective illustrating a wall reinforced by in situ formed composite reinforcing members.

Under the improved method the saturating adhesive is applied to the fabric strips as described above, and it absorbs into and adsorbs onto the fabric strips. The fabric strips are subsequently forced against the paste strips 220–224 on the wall, causing the saturating adhesive therein to adhere to the nonporous paste adhesive previously applied. The fabric strips 221, 223 and 225 are shown in place in FIG. 16.

There is no substantial loss of saturating adhesive from the fabric strips, because the paste strips 220–224 prevent the saturating adhesive from coming into contact with the pores of the wall and being wicked away. But the saturating adhesive can adhere to the paste adhesive, thereby forming a very strong bond between the in situ formed fabric strip reinforcing members and the wall.

Although this pre-pasting method has been described with respect to spaced strips formed in situ, it can also be used with any in situ formed reinforcement that uses a low viscosity saturating adhesive, such as the waterproofing sheets described above with respect to FIGS. 8 and 9.

The process of reinforcing walls with composite materials is an inherently complex one, requiring knowledge of civil engineering, construction and the properties of materials and adhesives. One who is familiar with the technical aspects of wall reinforcements normally would not be skilled in installing the reinforcement, and one who is familiar with the installation ordinarily would not have the technical knowledge to design the appropriate amount of reinforcement for a particular wall.

A process has been conceived whereby one with construction skill, but limited technical expertise, can install a wall reinforcing structure. This process involves the use of an array of spacing distances that is created for a particular set of circumstances prior to the installation process. This array, or these arrays if there is more than one, is available to the installer, who consults the array for the circumstances he or she is facing to determine the spacing of the reinforcing members on the wall. Using the methods described above for installing pre-cured plates and in situ formed composites, the improved process includes the step of consulting an array to determine the spacing or number of layers of reinforcing members. This process is described below in more detail.

FIG. 22 shows an array, in table form, of a plurality of spacing distances for a ten inch thick block wall. The table is divided into rows of wall heights and columns of backfill heights and this array was created taking into consideration parameters known to a person of skill in the engineering field, including wall type, wall thickness, wall material properties, soil properties, reinforcing material properties and dimensions, etc. At the intersection of each row with each column is a spacing distance for reinforcing members on a wall having the wall height indicated by that row, and the backfill height indicated by that column. The installer of the reinforcing member measures the wall height and backfill height and then uses the table of FIG. 22 to select a spacing distance between reinforcing members. Then he or she can install the reinforcing members that the table was made for at the appropriate spaced interval sufficient to reinforce the wall. This is shown as $d_5$, for example, in FIGS. 1 and 16.

Without the array, the spacing of reinforcing members on each wall has to be calculated separately by an expert in several different areas of technology. But by using the array method, one with substantial expertise in construction and little or no expertise in the technical areas can adequately reinforce a wall.

FIG. 23 shows an array, again in table form, for a ten inch thick poured concrete wall. This table is used in an identical manner as the table of FIG. 22, in which an installer measures the wall height and backfill height and finds the intersection of the row and column representing those heights. At that intersection is a spacing distance that represents the distance the reinforcing members must be spaced to sufficiently reinforce the wall under the circumstances for which the table was created.

It is contemplated that there can be as many arrays as there are types of walls and wall environments. Furthermore, such an array can be stored in computer memory as part of, for example, a database. A person of ordinary skill in the art of civil engineering and composite materials could construct such arrays from the description above using standard load calculation equations.

It is to be understood that the same array principle can be used with any of the herein described methods. By taking into consideration the important parameters of each situation, one can conceivably have an array for every possible set of circumstances. Thus, one can determine the spacing of rods in grooves, the spacing of in situ formed reinforcing members, the spacing of reinforcing plates and the number of layers of waterproofing sheets. Preferably, this information is all stored in printed tables or the memory of a computer for retrieval, such as in a database.

Additionally, the arrays shown are exemplary, but not intended to limit the types of arrays that can be used with the present invention. The parameters chosen are not the only possible parameters, because skilled construction personnel can measure more parameters than wall and backfill height.

The in situ formed reinforcing members, such as the fabric strips, and the pre-cured reinforcing members that are adhered to the wall have all been shown and described above mounted substantially vertically. This is because a significant portion of the failures on walls could have been prevented by reinforcing members that are vertically oriented. However, there is another significant portion of the failures that would best be prevented, or repaired, by horizontally or other non-vertically oriented reinforcing members.

Figure 24:
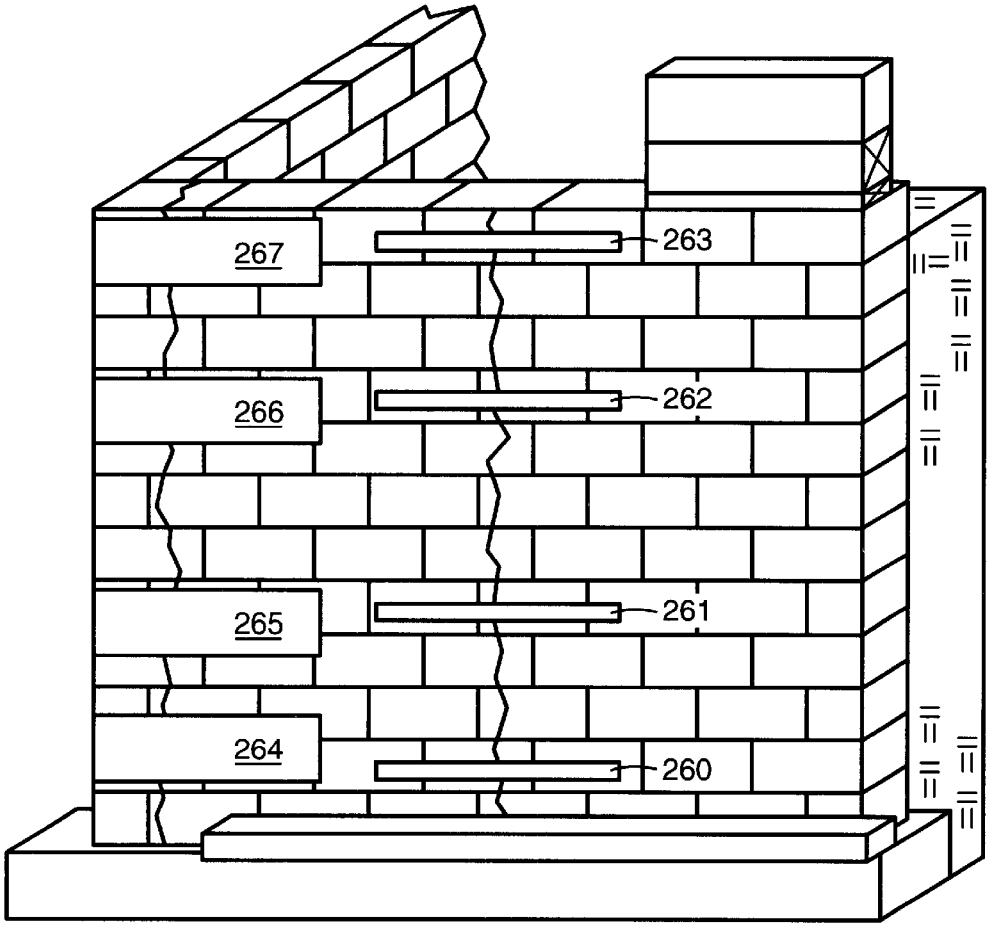
FIG. 24 is a view in perspective illustrating an alternative embodiment of the present invention.

As shown in FIG. 24, there are often vertical cracks that develop in walls that must be repaired. Therefore, pre-cured reinforcing plates 260–263 can be mounted horizontally across the crack with at least five feet of plate on either side of the crack. These plates can be spaced at approximately every 2.5 feet on center, or some other spacing distance that is deemed appropriate, for example according to an array created for this situation.

Alternatively, fabric strips, which are similar to the vertically oriented fabric strips described above, can be installed horizontally over the crack to form reinforcing members 264–267 in situ. The in situ reinforcing members 264–267 are especially advantageous when the crack is near or at a corner, as shown. This is because as the reinforcing members are formed they are flexible, and therefore their components, such as fabric strips, can be bent around corners to provide the necessary length of adhered reinforcing member on opposite sides of any crack.

In the case of an inside corner as shown, the inside corner of the wall should be rounded to approximately a three-quarter inch radius before installation. This permits proper adhesion of the reinforcing member, and prevents the concentration of too much stress in one region of the reinforcing member. The reinforcing member should be wrapped at least eight inches around the corner and at least eight inches on the opposite side of the crack for proper strength.

While certain preferred embodiments of the present invention have been disclosed in detail, it is to be understood that various modifications may be adopted without departing from the spirit of the invention or scope of the following claims. It is especially to be noted that the embodiments of the invention noted above may be combined with conventional means and methods for reinforcing walls, such as beams, channels and anchors.

What is claimed is:

1. A method of reinforcing a wall having an interior wall surface against a force having a component substantially perpendicular to the wall, the method comprising:

(a) forming an array of spacing distances, each of which represents a distance between a first reinforcing member and a second reinforcing member that is sufficient to reinforce the wall, said spacing distances being based upon the characteristics of the wall and its environment, and said reinforcing members being made of a polymer matrix reinforced by embedded fibers;

(b) selecting from the array a spacing distance based upon at least one wall parameter;

(c) disposing a first major surface of the first reinforcing member in a substantially parallel, facing orientation relative to the interior wall surface;

(d) applying adhesive to at least one of said surfaces;

(e) forcing the first major surface of the first reinforcing member against the interior wall surface to mount the reinforcing member in a facing relationship to the interior wall surface with the adhesive interposed between the reinforcing member and the wall;

(f) disposing a first major surface of the second reinforcing member in a substantially parallel orientation relative to the interior wall surface and facing the interior wall surface;

(g) applying adhesive to at least one of said surfaces; and (h) forcing the first major surface of the second reinforcing member against the interior wall surface to mount the reinforcing member at a distance from the first reinforcing member substantially equal to the selected spacing distance in a facing relationship to the interior wall surface with the adhesive interposed between the reinforcing member and the wall.

2. The method in accordance with claim 1, further comprising:

(a) disposing a major surface of each of a plurality of reinforcing members in a substantially parallel, facing orientation relative to the interior wall surface;

(b) applying adhesive to at least one of said surfaces;

(c) forcing each of the major surfaces of the reinforcing members against the interior wall surface to mount the reinforcing members in a facing relationship to the interior wall surface, wherein each of said reinforcing members is spaced from each adjacent reinforcing member a distance substantially equal to the spacing distance.

3. The method in accordance with claim 1, wherein the reinforcing member is formed by applying a saturating resin adhesive having a viscosity substantially equal to or less than about 20,000 cps to an elongated strip of reinforcing fibers, said resin adhesive absorbing into and adsorbing onto the strip.

4. The method in accordance with claim 1, wherein the reinforcing member is a plate made of a cured polymer matrix reinforced by embedded fibers.

5. The method in accordance with claim 4, further comprising abrading the first major surface of the rigid plate for increasing the surface area of the first major surface to enhance the adhesion of the adhesive to the plate.

6. The method in accordance with claim 4, further comprising mounting at least one fastener to the plate and the wall, said fastener extending into an opening in the wall.

7. The method in accordance with claim 1, wherein the array is in the form of a table.

8. The method in accordance with claim 1, wherein the array is in the form of data stored in retrievable computer memory.

9. The method in accordance with claim 1, further comprising preparing the interior wall surface for attachment of the reinforcing member thereto.

10. The method in accordance with claim 9, wherein the step of preparing the interior wall surface comprises removing matter from the interior wall surface by mechanically cleaning the surface.

11. The method in accordance with claim 9, wherein the step of preparing the interior wall surface comprises removing matter from the interior wall surface by chemically cleaning the surface.

12. A method of reinforcing a wall having an interior surface against a force having a component substantially perpendicular to the wall, the method comprising:

(a) applying a paste adhesive having viscosity greater than about 20,000 cps to a selected area of the interior wall surface;

(b) applying a saturating resin adhesive having a viscosity substantially equal to or less than about 20,000 cps to an elongated strip of reinforcing fibers, said resin adhesive absorbing into and adsorbing onto the strip;

(c) disposing a first major surface of the strip in a substantially parallel, facing orientation relative to the interior wall surface at the selected area; and (d) forcing the first major surface of the strip against the selected area of the interior wall surface to mount the strip in a facing relationship to the interior wall surface.

13. The method in accordance with claim 12, further comprising:

(a) applying a paste adhesive having viscosity greater than about 20,000 cps to a plurality of selected areas of the interior wall surface;

(b) applying a saturating resin adhesive having a viscosity substantially equal to or less than about 20,000 cps to a plurality of elongated strips of reinforcing fibers, said resin adhesive absorbing into and adsorbing onto the strips;

(c) disposing a major surface of each of the strips in a substantially parallel, facing orientation relative to the interior wall surface at the selected areas onto which the paste adhesive is applied; and (d) forcing the major surfaces of the strips against the selected areas of the interior wall surface to mount the strips in a facing relationship to the interior wall surfaces.

14. The method in accordance with claim 12, further comprising preparing the interior wall surface for attachment of the strip thereto.

15. The method in accordance with claim 14, wherein the step of preparing the interior wall surface comprises removing matter from the interior wall surface by mechanically cleaning the surface.

16. The method in accordance with claim 14, wherein the step of preparing the interior wall surface comprises removing matter from the interior wall surface by chemically cleaning the surface.

17. A method of reinforcing a wall having an interior surface against a force having a component substantially perpendicular to the wall, the method comprising:

(a) forming an array of spacing distances, each of which represents a distance between a first elongated strip of reinforcing fibers and a second elongated strip of reinforcing fibers that is sufficient to reinforce the wall, said spacing distances being based upon the characteristics of the wall and its environment;

(b) selecting from the array a spacing distance based upon at least one wall parameter;

(c) applying a paste adhesive having viscosity greater than about 20,000 cps to a first selected area on the interior wall surface;

(d) applying a saturating resin adhesive having a viscosity substantially equal to or less than about 20,000 cps to the first strip, said resin adhesive absorbing into and adsorbing onto the first strip;

(e) disposing a first major surface of the first strip in a substantially parallel, facing orientation relative to the interior wall surface;

(f) forcing the first major surface of the first strip against the interior wall surface at the first selected area to mount the first strip in a facing relationship to the interior wall surface with at least one of the adhesives interposed between the first strip and the wall;

(g) applying a paste adhesive having viscosity greater than about 20,000 cps to a second selected area of the interior wall surface spaced from the first selected area a distance substantially equal to the selected spacing distance;

(h) applying a saturating resin adhesive having a viscosity substantially equal to or less than about 20,000 cps to the second strip, said resin adhesive absorbing into and adsorbing onto the second strip;

(i) disposing a first major surface of the second strip in a substantially parallel, facing orientation relative to the interior wall surface; and (j) forcing the first major surface of the second strip against the interior wall surface at the second selected area to mount the second strip in a facing relationship to the interior wall surface with at least one of the adhesives interposed between the second strip and the wall.

18. The method in accordance with claim 17, further comprising:

(a) applying a paste adhesive having viscosity greater than about 20,000 cps to a plurality of areas of the interior wall surface, said plurality of areas spaced from each other a distance substantially equal to the selected spacing distance;

(b) applying a saturating resin adhesive having a viscosity substantially equal to or less than about 20,000 cps to a plurality of strips, said resin adhesive absorbing into and adsorbing onto the plurality of strips;

(c) disposing a major surface of each of the plurality of strips in a substantially parallel, facing orientation relative to the interior wall surface; and (d) forcing each major surface of the plurality of strips against the interior wall surface at one of the selected areas, one strip per selected area, to mount the plurality of strips in a facing relationship to the interior wall surface with at least one of the adhesives interposed between the strips and the wall.

19. The method in accordance with claim 17, wherein said array is in the form of a table.

20. The method in accordance with claim 17, wherein the array is in the form of data stored in retrievable computer memory.

21. The method in accordance with claim 17, further comprising preparing the interior wall surface for attachment of the reinforcing strips thereto.

22. The method in accordance with claim 21, wherein the step of preparing the interior wall surface comprises removing matter from the interior wall surface by mechanically cleaning the surface.

23. The method in accordance with claim 21, wherein the step of preparing the interior wall surface comprises removing matter from the interior wall surface by chemically cleaning the surface.

* * * * *